US007044465B2

(12) United States Patent
Liu

(10) Patent No.: US 7,044,465 B2
(45) Date of Patent: May 16, 2006

(54) STRATEGY GAME WITH GEOMETRICAL STRUCTURE

(76) Inventor: Jianguo Liu, 105 Beech St. #3, Belmont, MA (US) 02478

( * ) Notice: Subject to any disclaimer, the term of this patent is extended or adjusted under 35 U.S.C. 154(b) by 4 days.

(21) Appl. No.: 10/868,310

(22) Filed: Jun. 15, 2004

(65) Prior Publication Data

US 2005/0029736 A1 Feb. 10, 2005

Related U.S. Application Data

(63) Continuation-in-part of application No. 10/120,531, filed on Apr. 11, 2002, now abandoned.

(51) Int. Cl.
*A63F 3/00* (2006.01)

(52) U.S. Cl. ..... 273/241; 273/276; 273/287

(58) Field of Classification Search ..... 273/241, 273/276, 287, 283, 153 R, 157 R, 158, 275, 273/264, 266; D21/344
See application file for complete search history.

(56) References Cited

U.S. PATENT DOCUMENTS

| | | | | |
|---|---|---|---|---|
| 1,400,066 | A | 12/1921 | Huck | |
| 2,765,580 | A * | 10/1956 | Herrschaft | 446/119 |
| 2,801,107 | A | 7/1957 | Greer, Jr. | |
| 2,810,390 | A * | 10/1957 | Wallace et al. | 135/160 |
| 3,422,565 | A * | 1/1969 | Dreyfuss et al. | 446/102 |
| 3,452,989 | A | 7/1969 | Jernstrom | |
| 3,606,333 | A | 9/1971 | Green | |
| 4,456,258 | A | 6/1984 | Lodrick | |
| 5,613,681 | A | 3/1997 | Allen | |
| 5,678,819 | A | 10/1997 | Underwood | |
| 6,120,027 | A | 9/2000 | Frankel et al. | |
| 6,276,685 | B1 | 8/2001 | Sterling | |
| 6,276,687 | B1 | 8/2001 | Lenhart | |

* cited by examiner

*Primary Examiner*—Vishu K. Mendiratta
(74) *Attorney, Agent, or Firm*—Pandiscio & Pandiscio

(57) ABSTRACT

The present invention is an educational and recreational apparatus having a geometrical structure game device comprising a framework of tubes and connector wires characterized by a plurality of nodes on which game pieces can be embedded. Each node comprises a cluster of portions of two or more pairs of connector wires, with the nodes of a game device being identical or differing from one another in the number of pairs of connector wires that form the nodes. The game device can take the form of a two-dimensional or three-dimensional, single-plane or multi-plane, latticed or non-latticed geometrical structure. The game is played with two sets of game pieces, one set for each of two players. The game pieces have slots therein for accommodating the connector wire portions that make up a node, with each set including game pieces that vary according to the variety of nodes in a game device. The game pieces in each group are categorized by different degrees of freedom as determined by the number of slots in the game piece. The game is played by embedding game pieces on the different nodes according to a set of rules, and the player who occupies more nodes than opponent wins the game.

19 Claims, 28 Drawing Sheets

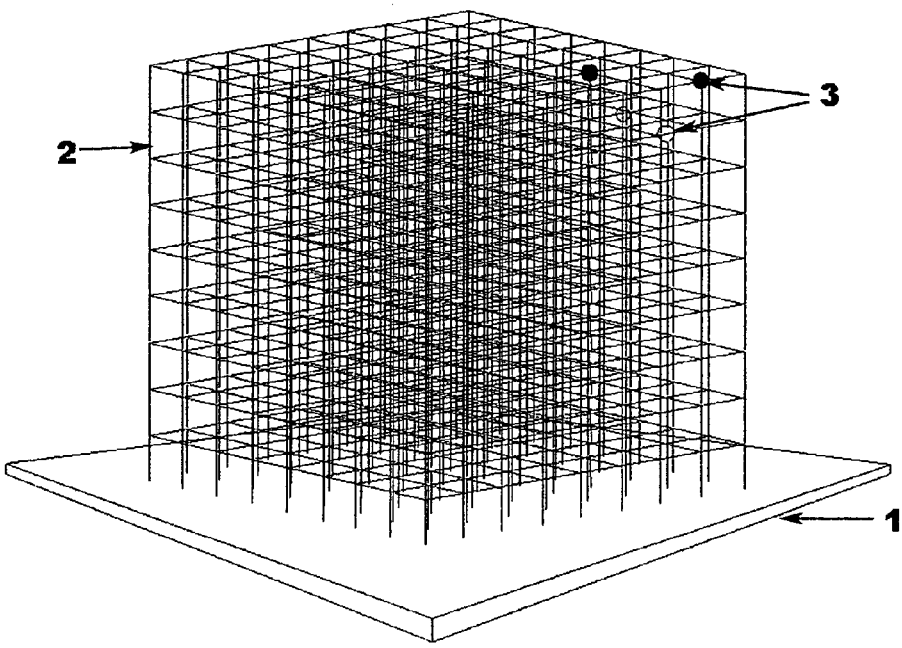
Fig.4A
Fig.4B
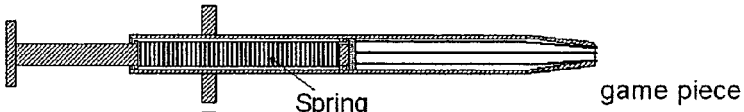
Fig.4C
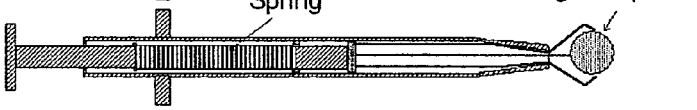
Fig.4D
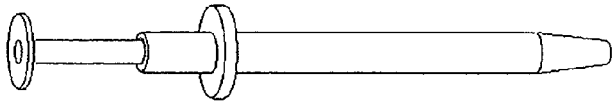

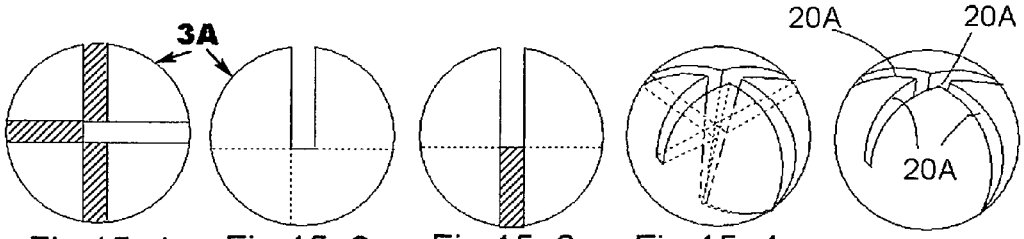
Fig.15a1 Fig.15a2 Fig.15a3 Fig.15a4 Fig.15a5
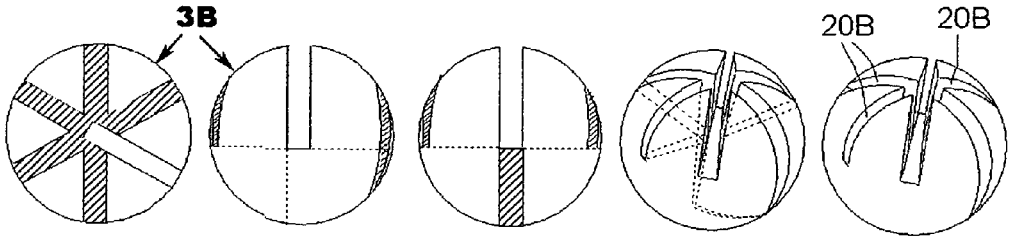
Fig.15b1 Fig.15b2 Fig.15b3 Fig.15b4 Fig.15b5
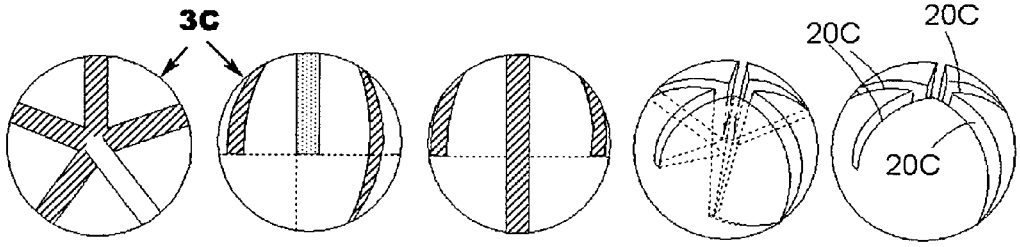
Fig.15c1 Fig.15c2 Fig.15c3 Fig.15c4 Fig.15c5

STRATEGY GAME WITH GEOMETRICAL STRUCTURE

This is a continuation-in-part of my U.S. patent application Ser. No. 10/120,531, filed Apr. 11, 2002 now abandoned for "Strategy Game With Geometrical Structure".

FIELD OF THE INVENTION

This invention relates to a new and improved strategy game played on geometric structures such as latticed or none-latticed nets, dodecahedrons, icosahedrons, hexahedral, spheres, or any combination comprising nodes construction made from tubes and rigid connecting wires bent at selected angles.

DESCRIPTION OF RELATED ART

The present invention is a strategy game comprising (1) a game device in the form of a geometric structure characterized by tubes and wires, (2) two sets of playing game pieces with different degree of freedom defined by the number of slots in each game piece, and (3) a set of specific playing rules. It is different from prior disclosed multi-plane strategy game devices such as the ones described in the patents listed below.

U.S. Pat. No. 5,613,681, issued to Allen, discloses a multi-plane strategy game structure that consists of a lattice type matrix forming a plurality of open cubes. When playing, players insert game pieces, the play balls, into the center of the cube of the matrix.

U.S. Pat. No. 6,276,687B1, issued to Lenhart, discloses a multi-board game. Although the inventor defines the game as a board game, it provides players a multi-plane game device to form squares of one color with game pieces.

U.S. Pat. No. 6,276,685B1, issued to Sterling, discloses a three-dimensional board game. The game structure is also a multi-board structure, like the U.S. Pat. No. 6,276,687B1, and provides players a multi-plane game device instead of the flat single plane game board.

U.S. Pat. No. 5,678,819, issued to Underwood, discloses a three-dimensional strategy game. The game is played on a multi-board game structure, and game pieces are moveable among game boards.

U.S. Pat. No. 2,801,107, issued to Greer, Jr., discloses a three-dimension game device of rectangular wire construction with upstanding peg portions and a plurality of bead elements engaging with said peg portions.

U.S. Pat. No. 3,606,333, issued to Green, discloses a multi-plane strategy game device comprising a hexahedral framework of rods arranged to form a compact array of eight hexahedral elements and a plurality of game pieces each formed with a bisecting slot arranged to intersect rods of the framework.

U.S. Pat. No. 4,456,258, issued to Lodrick, discloses an icosahedron geodesic sphere or geometric solid game device. The outer surface of the geometric solid is covered with an appropriate map or grid pattern to provide separate playing positions and thus specific moves of play are possible.

U.S. Pat. No. 6,120,027, issued to Frankel, discloses a two or three-dimensional strategy game device called playing surface with a continuous arrangement of a plurality of polygonal areas.

U.S. Pat. No. 3,452,989, issued to H. Jernstrom, discloses a game apparatus including a playing board on which players build squares and cubes with rods and couplers which are used for joining rods.

U.S. Pat. No. 1,400,066, issued to A. Huck, discloses a toy set apparatus including tubular struts, detachable short solid arm bars and connecting pieces with holes to be used for assembling shot arm bars.

None of above cited patents discloses a game apparatus as in the present invention that utilizes a geometrical structure from tubes and wires bent in various angles and connected so as to define nodes for receiving game pieces with predetermined degrees of freedom. The above cited patents do not disclose a game device as in the present invention having varied game pieces with degrees of freedom defined by the number of slots in the game piece. The above cited patents also do not disclose a game playing method and rules like the method and rules of the present invention.

SUMMARY OF THE INVENTION

The present invention pertains to and comprises a new and improved multi-plane strategy game played on a single or multi-plane geometrical structure. Unlike prior art strategy games such as multi-board strategic games and games with 3-dimensional matrix, the present invention comprises a geometrical game device characterized by nodes formed by rigid or stiff wires and development of a strategic game that comprises embedding spherical game pieces on nodes of the geometrical game device by following a set of playing rules.

The game devices developed by the present invention are geometrical structures of various types and shapes comprising a plurality of nodes for emplacement of game pieces. Some game devices are two-dimensional and others are three-dimensional; some of them are constructed on a single-plane space and others are built on a multi-plane space; some game structures are latticed and others are non-latticed.

The game pieces of the present invention are spherical shaped balls with slots (grooves) for embedding the balls on nodes of the game device. The slots (grooves) in the game pieces are arranged to allow the game pieces to be interlocked with all of the wire connectors that form a node. The game pieces are described as two-degree, three-degree, four-degree, etc. according to the number of slots therein. Thus, a game piece with four grooves is a four-degree game piece, and a game piece with six grooves is a six-degree game piece.

All game pieces are divided into two groups. Each group associates a single player and has a plurality of game pieces with identical color and varied degrees. The game begins with no game pieces positioned on the game device. Players embed, i.e., place, game pieces in turn on nodes of the game device. Once a game piece is embedded on a node of the game device, it may not be moved or removed until it is captured by another colored game pieces, or the game is over.

A game piece embedded on a node is considered to be captured when all adjacent nodes are occupied by different colored game pieces. A group of game pieces are captured if all nodes adjacent to the group are occupied by opponent pieces and there are no non-occupied nodes inside the group. The player who occupies the most nodes wins a game. However, since certain nodes of a game device are more advantageous than other nodes and the first occupier of these nodes usually has more advantages, for example, nodes on the $2^{nd}$ and $3^{rd}$ lines from the corner of a latticed game device may have more advantage than others for controlling the corner, the present invention sets up rules inclining to the second mover to balance the second mover's disadvantage.

BRIEF DESCRIPTION OF THE DRAWINGS

FIG. 4A is a perspective view of a 6-degree, three-dimensional, multi-plane latticed game device with 9×9×9 pattern on a baseboard, with several game pieces 3 embedded on nodes of the game device which is built up on the baseboard 1.

FIG. 4B is the sectional drawing of a clip, the tool used to load and unload game pieces to and from inner nodes of a game device, e.g., the game device shown in FIG. 4A.

FIG. 4C is a sectional drawing of the same clip when the clip is in use for holding a game piece.

FIG. 4D is a perspective view of the same clip.

FIGS. 15*a*1 to 15*a*5 illustrate a 4-degree game piece.

FIGS. 15*b*1 to 15*b*5 illustrate a 6-degree game piece.

FIGS. 15*c*1 to 15*c*5 illustrate a 5-degree game piece.

In the several figures the like numerals identify like parts.

DETAILED DESCRIPTION OF THE PRESENT INVENTION

Figure 5:
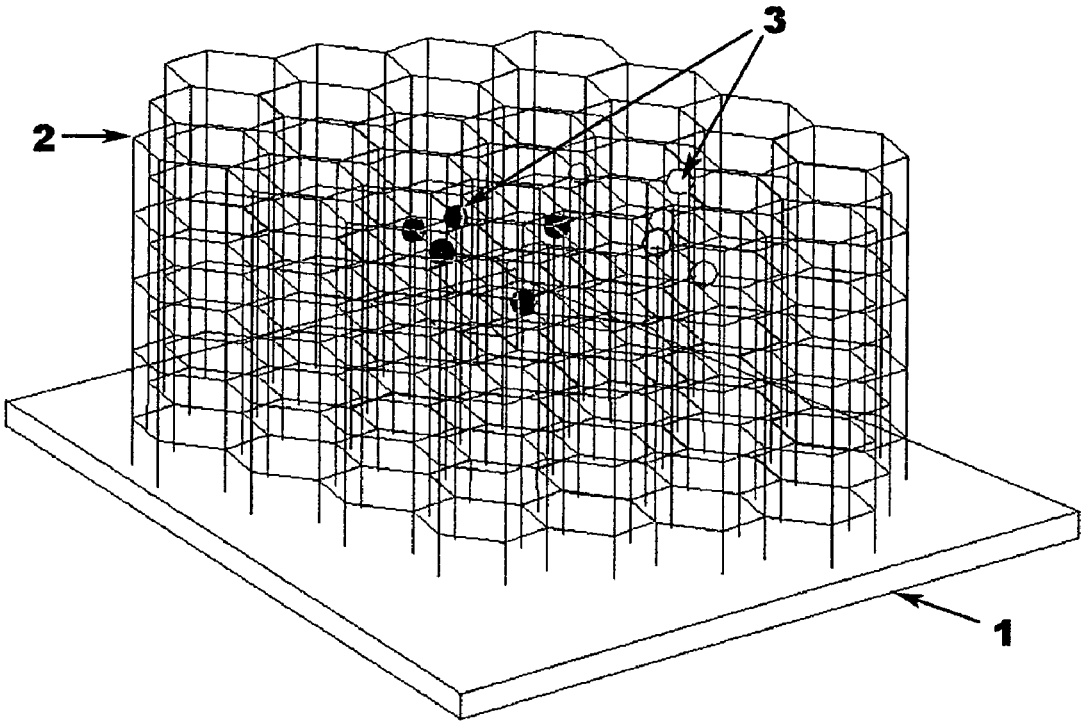
FIG. 5 is a perspective view of a three-dimensional, multi-plane latticed game device with honeycomb pattern, with game pieces embedded on nodes of the game device structure.
Figure 6:
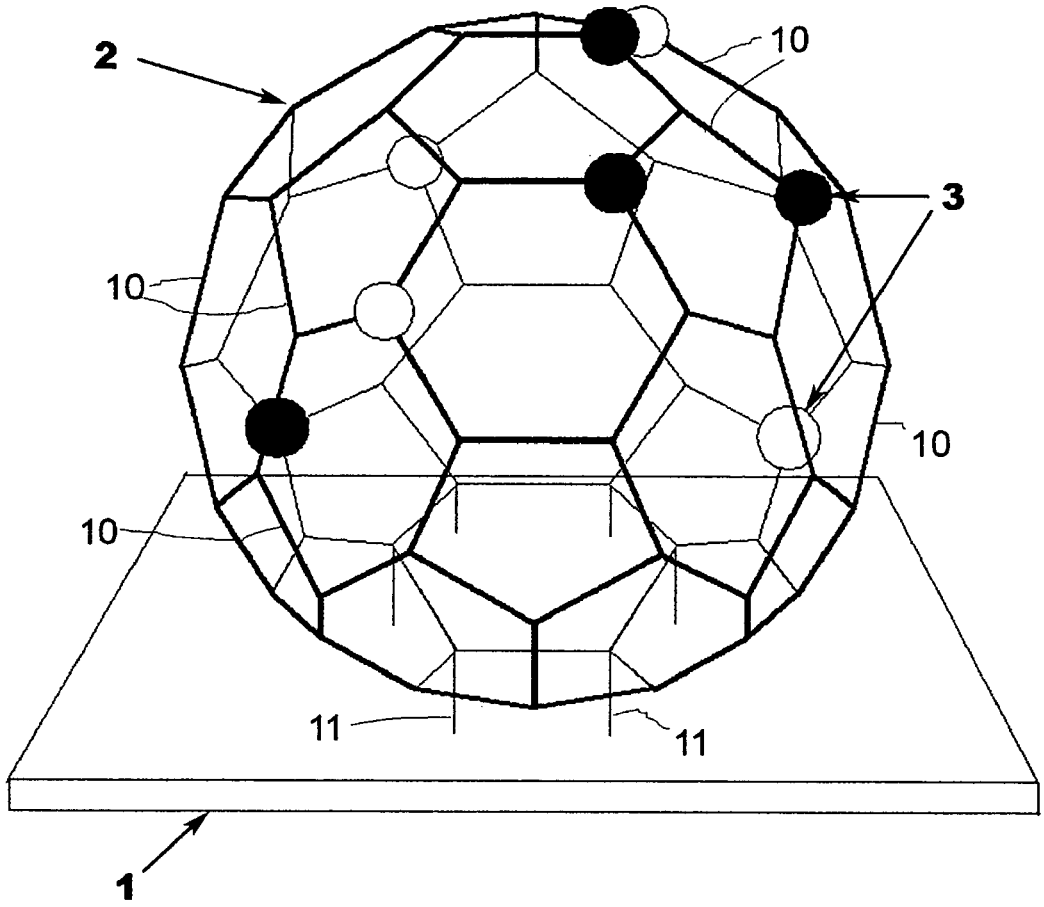
FIG. 6 is a perspective view of a three-dimensional, 16-plane non-latticed game device built on a baseboard with game pieces on the nodes.
Figure 7:
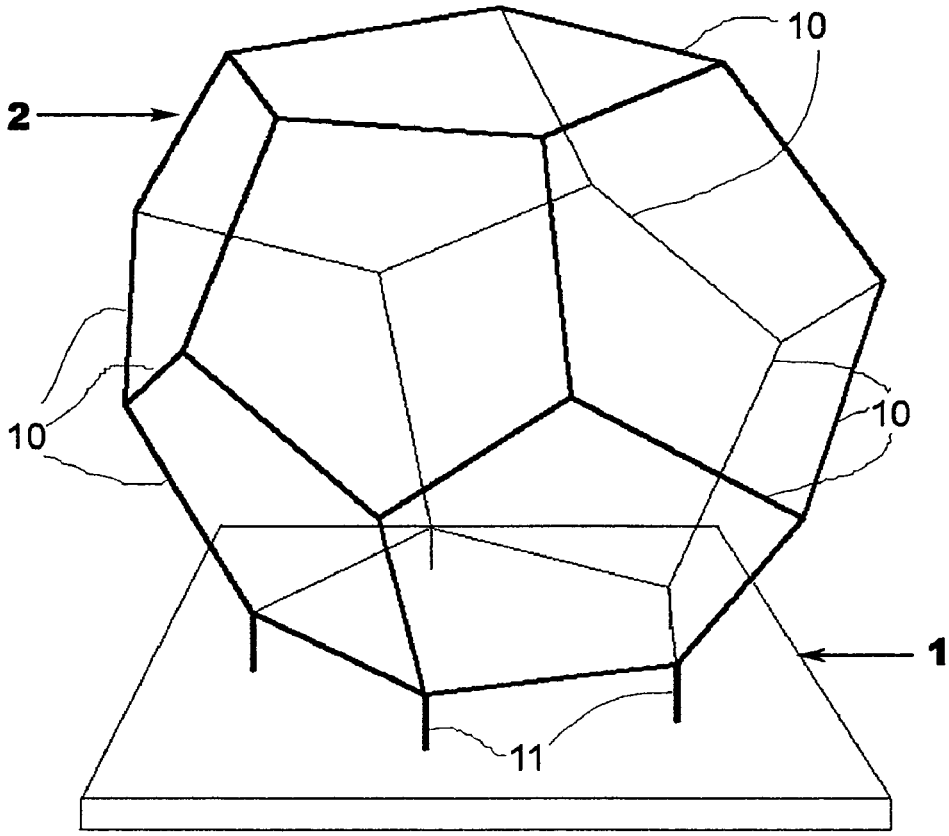
FIG. 7 is a perspective view of a three-dimensional, 6-plane non-latticed game device. This game device is a Dodecahedron shape structure on a baseboard.
Figure 8:
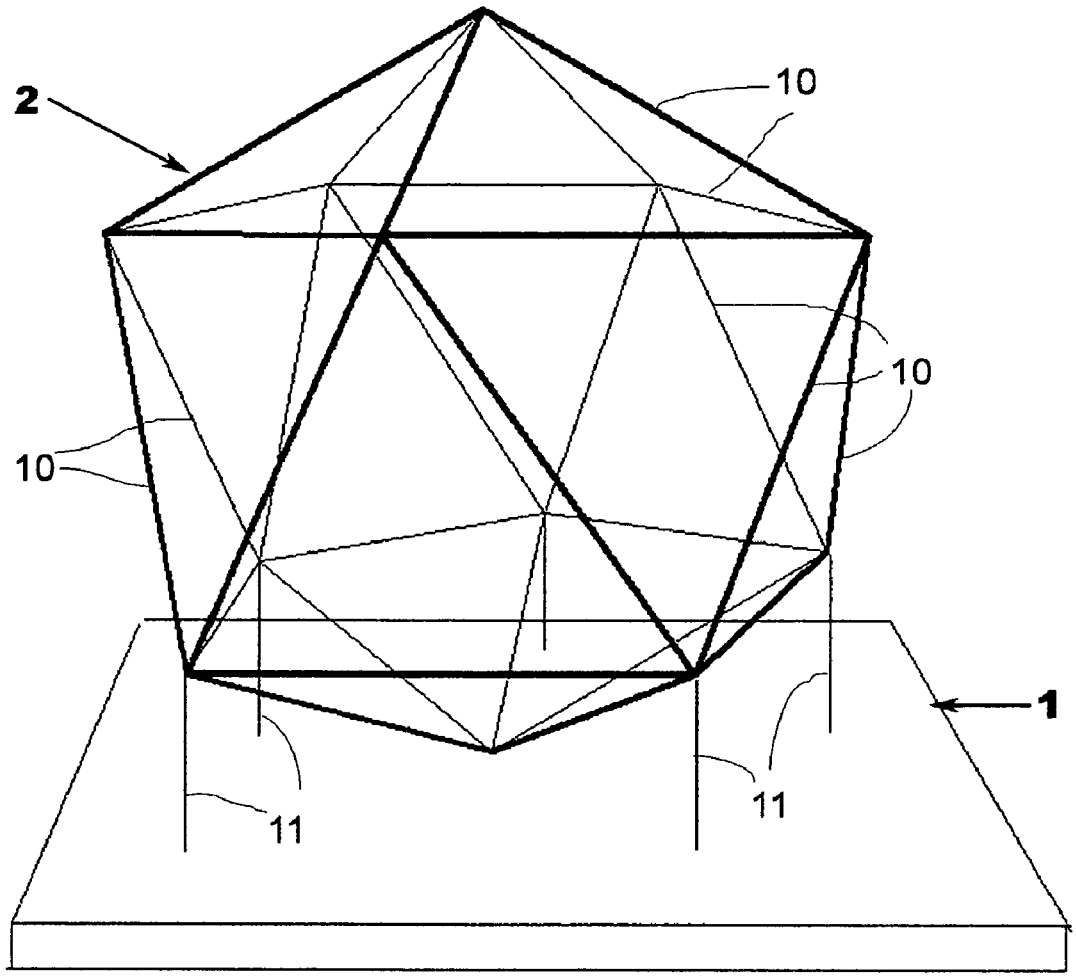
FIG. 8 is a perspective view of a three-dimensional, 10-plane non-latticed game device. This game device is a typical Icosahedron shape structure built on a baseboard.
Figure 9A:
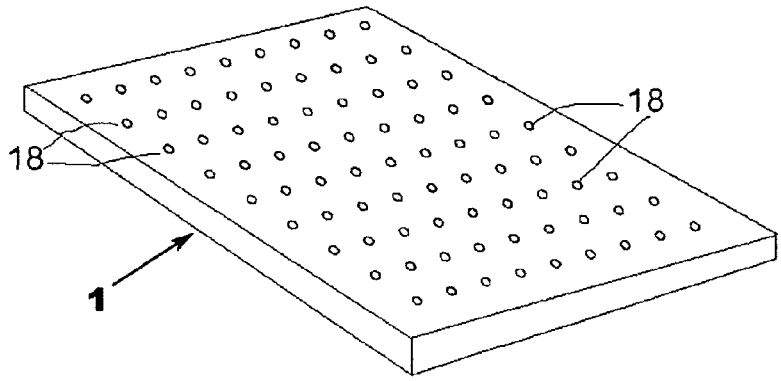
FIG. 9A is a perspective view of a baseboard with holes arranged in a row and column configuration.
Figure 9B:
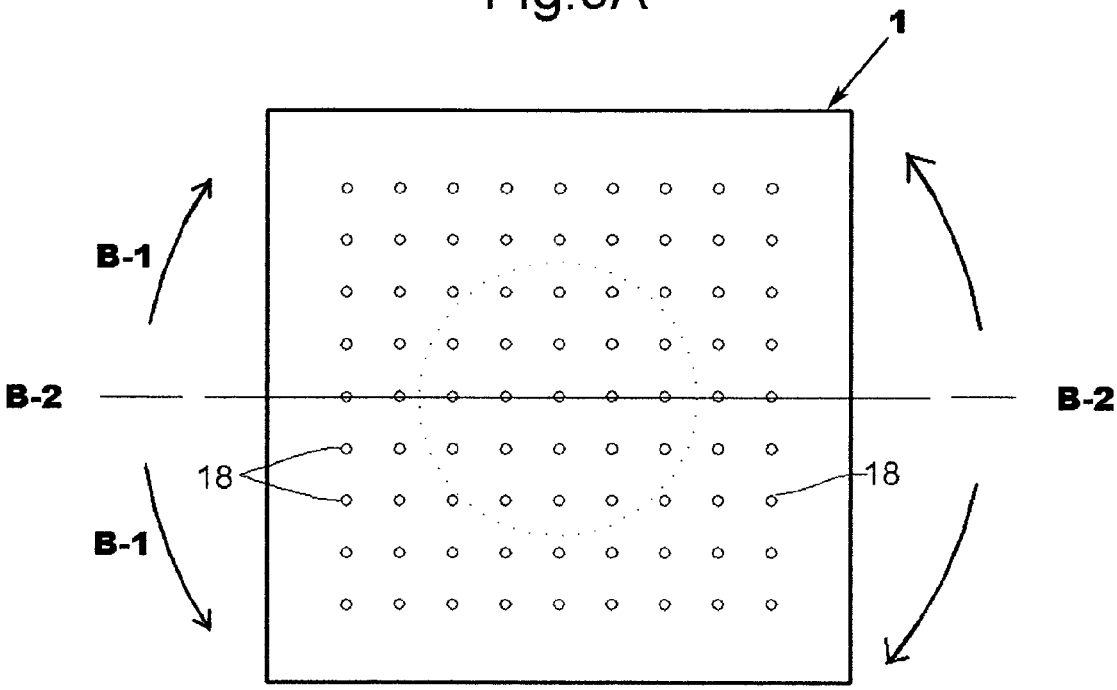
FIG. 9B is a plan view of the baseboard of FIG. 9A.
Figure 9C:
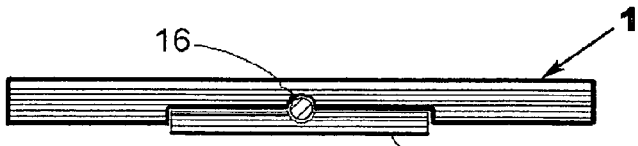
FIG. 9C is a sectional drawing of the baseboard taken along section Line B-2.

FIGS. 1 to 4A and 5 to 8 schematically illustrate different geometric structure game devices made using a tube and wire connector mode of construction as illustrated in FIGS. 11 to 14. Some of these game devices are two-dimensional geometrical structures as depicted in FIG. 1A, FIG. 2A and FIG. 3A, and others are three-dimensional as illustrated in FIG. 4A, FIG. 5, FIG. 6, FIG. 7 and FIG. 8. Some of these game devices are set in a one-plane space as depicted in FIG. 1A, FIG. 2A and FIG. 3A, and others are built in a multi-plane space as depicted in FIG. 4A, FIG. 5, FIG. 6, FIG. 7 and FIG. 8. The game device may have a latticed construction as shown in FIG. 4A or a non-latticed construction as illustrated in FIG. 6, FIG. 7 and FIG. 8.

In the drawings, the numerals 1, 2 and 3 identify a baseboard, a geometrical game device and game pieces respectively. The geometric structure game devices comprise a plurality of nodes 9 (defined hereinafter) made from tubes 7 and wire connectors 8 (FIGS. 11B to 11G). In FIGS. 1 to 4A and 5 to 8 the lines 10 represent tubes 7 and wire connectors 8 that are interconnected to form the game device with nodes 9 and the lines 11 represent the tubes 7 that are inserted into holes in the baseboard and serve as legs that anchor the game device to the baseboard.

Figure 1A:
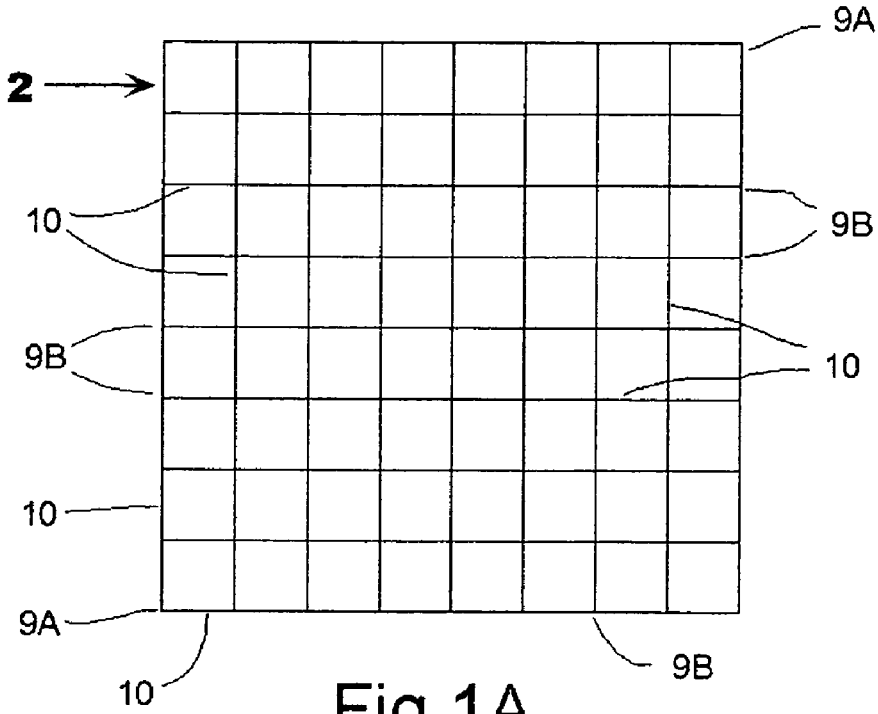
FIG. 1A is the top down (plan) view of a 4-degree, two-dimensional game device.

The nodes 9 are classified according to degrees of freedom as determined by the geometry of the game device and the specific location of the node in the game device structure. Thus, for example, the four corner nodes 9A of the game device in FIG. 1A are two-degree nodes since each has only two lines 10 that extend to other nodes, i.e., the node requires a two-degree game piece. The nodes 9B along the four sides of the game device in FIG. 1A are all three-degree nodes since each of them has only three lines 10 that extend to other nodes. All other inner nodes of the game device in FIG. 1A are four-degree nodes since they all have four lines extending to other nodes. The node with the highest degree of freedom in a game device determines the degree of freedom of the game device. Hence the game device in FIG. 1A is a 4-degree game device since its highest degree node is a 4-degree node.

Figure 2A:
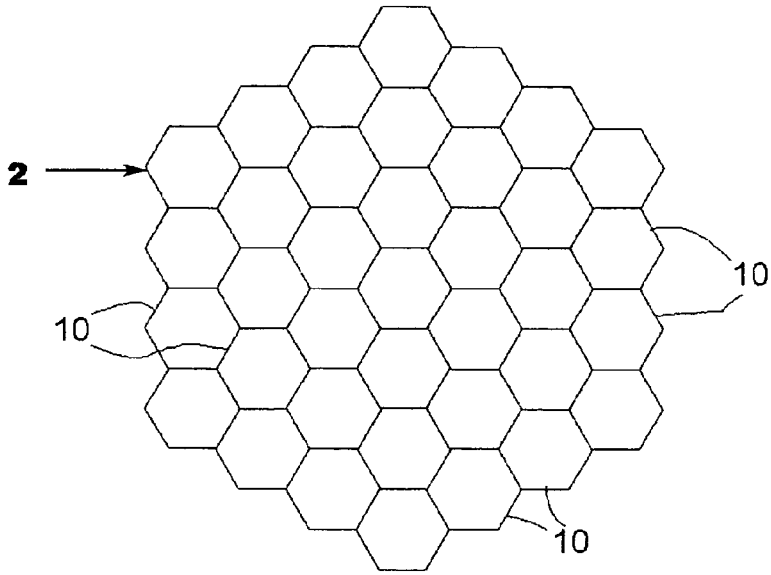
FIG. 2A is the top down view of a 3-degree, two-dimensional game device with a honeycomb pattern.
Figure 2B:
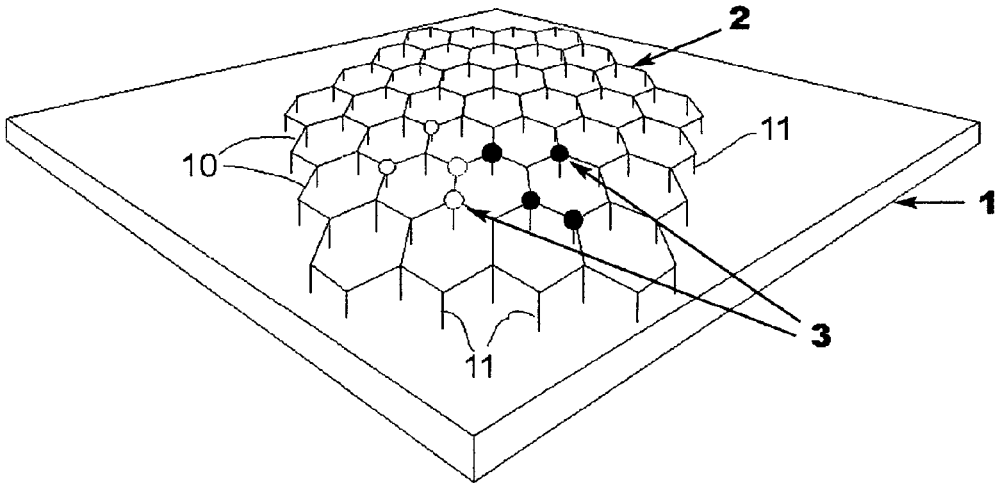
FIG. 2B is the perspective view of the game device of FIG. 2A on a baseboard with several game pieces embedded on nodes of the structure.
Figure 3A:
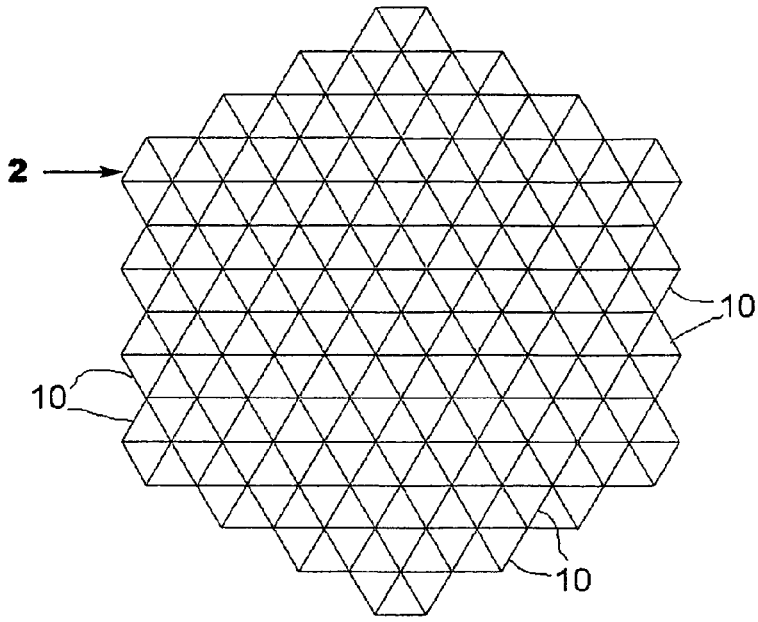
FIG. 3A is the top down view of a 6-degree, two-dimensional, single-plane and non-latticed game device with enhanced honeycomb pattern.
Figure 3B:
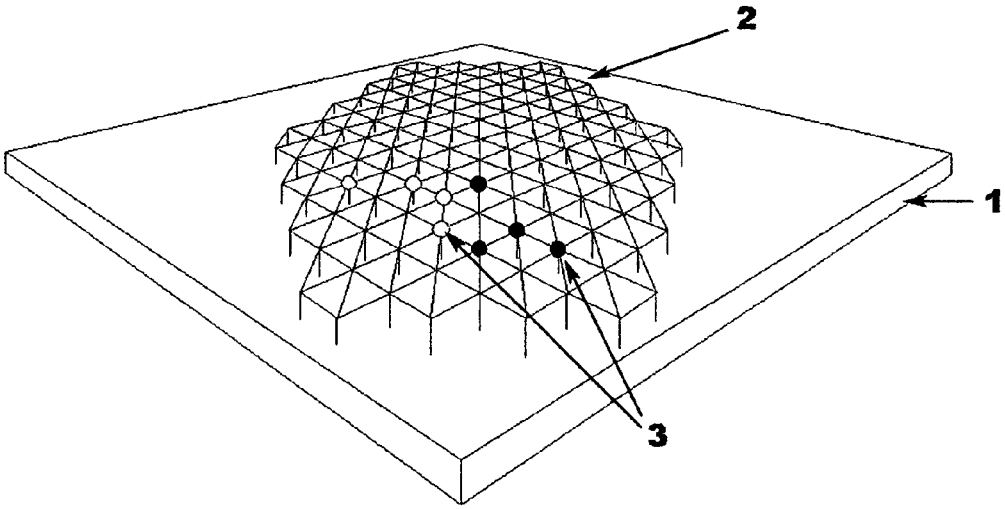
FIG. 3B is the perspective view of the game device of FIG. 3A on a baseboard with several game pieces embedded on nodes of the structure.

The game device shown in FIGS. 2A and 2B comprises two degree nodes along its periphery; all the other nodes of that device are three degree nodes. The game device shown in FIGS. 3A and 3B comprises three and five degree nodes along its periphery; all the other nodes of that device are six degree nodes.

Latticed game devices are multi-degree game devices because a latticed device has corners and sides, and nodes in different positions will accordingly have with different degrees of freedom. Thus the game device depicted in FIG. 4A is a six-degree game device since the highest degree nodes are six-degree inner nodes. However, the game device of FIG. 4A has three-degree corner nodes as well as four-degree edge nodes and five degree side surface nodes.

The game device of FIG. 5 is a five degree, three dimensional, multi-plane latticed game device with a honeycomb structure with three and four-degree nodes. FIG. 6 shows a three-dimensional, multi-plane latticed game device with all nodes having three degrees of freedom. FIG. 7 shows a three-dimensional, multi-plane, non-latticed dodecahedron—shaped game device wherein every node has three degrees of freedom. FIG. 8 shows a three-dimensional, multi-plane, non-latticed icosahedron structure wherein every node has three degrees of freedom.

To help players to reach the inner nodes of latticed game devices like the ones illustrated in FIG. 4A and FIG. 5, the present invention suggests using a clip to load and unload game pieces. FIG. 4B to FIG. 4D illustrates the structure of the clip. FIG. 4B is a sectional drawing of the clip with its jaws held in retracted position by an internal spring. FIG. 4C is a similar sectional drawing showing the jaws of the clip holding a game piece. And FIG. 4D is a perspective view of the clip.

Figure 10A:
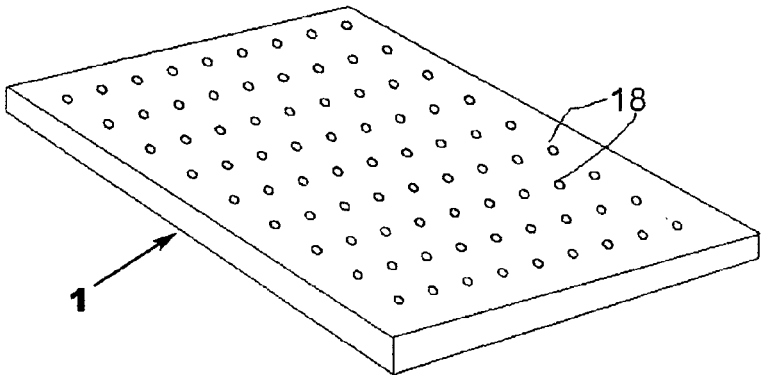
FIG. 10A is a perspective view of a baseboard with holes arranged in a honeycomb shape.
Figure 10B:
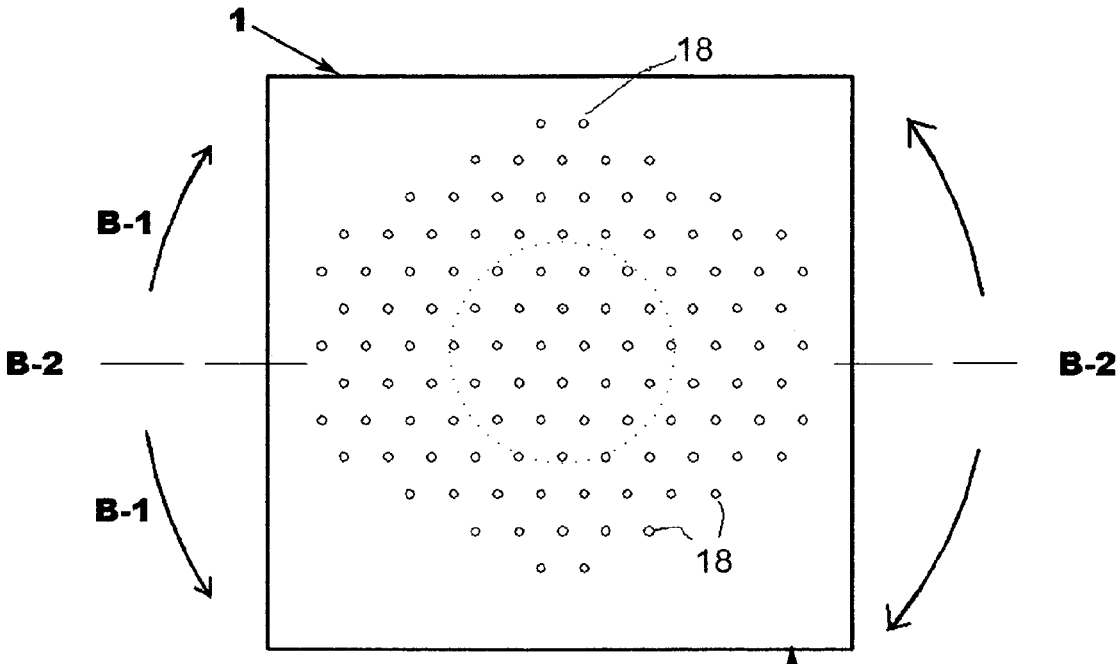
FIG. 10B is a plan view of the baseboard of FIG. 10A.

FIG. 9A to FIG. 10B depicts a rotational game device baseboard for use in practicing the present invention. As seen in FIG. 9C, the gameboard 1 is mounted for rotational movement on a disk 14 by means of a metal ball 16 that is seated in depressions in both the board and disk. The arrows B1 indicate that the baseboard can rotate in either direction relative to disk 14. The baseboard 1 provides a physical base for building geometrical structures with the tube-and-wire connecting method. The formation of a geometrical structure determines the arrangement of holes 18 on the baseboard for holding the tubes that form part of and support the game device. A latticed geometrical structure like the one in FIG. 4A or FIG. 1A requires the holes 18 on the baseboard to be arranged as a square shaped row and column pattern like the one illustrated in FIG. 9A to FIG. 9B, while a honeycomb shaped geometrical structure like the ones of FIG. 2A, FIG. 3A, FIG. 5, and FIG. 6 requires a honeycomb shaped pattern of holes as illustrated in FIG. 10A to FIG. 10B. A geometrical structure like those in FIG. 7 and FIG. 8 requires a pentagon—shaped holes arrangement on the baseboard.

The present invention utilizes and is based on a tube-and-wire-connecting method for constructing the geometrical structure game devices. FIG. 11B illustrates one of the tubes 7. The tubes 7 are identical in size and shape and all are open at both ends. FIGS. 11C to 11G illustrate different wire connectors 8 used in practicing the invention. The wires 8 are rigid or stiff and have substantially the same diameter. Each of the wire connectors is bent, so that it has an elbow or corner section between its opposite ends. As explained hereinafter, the angle of the elbow sections will vary according to the shape and style of the geometric shape of the game device that is to be constructed. Thus FIG. 11C shows a wire connector 8 bent at an angle of 60°; FIG. 11D shows a wire connector 8 bent at a 72° angle; FIG. 11E shows a wire connector 8 with a 90° elbow section; FIG. 11F shows a 108° angle wire connector, and FIG. 11G shows a wire connector with an elbow section having an angle of 120°. Users can select among these wire connectors to create a needed geometrical structure.

FIG. 11A and FIGS. 12 to 14 show how the tube-and-wire connecting method works. To help users understand the method better, these illustrations include baseboards for the game device. However, it is to be appreciated that game devices made using the tube-and-wire connecting method can be used without the baseboard support. To construct a geometrical structure game device without a baseboard, the user must first use tubes 7 and wires 8 to form a tube-and-wire base grid as the first layer or base of the geometrical structure, and then starting with the second layer, build up the geometrical structure itself above the base. For example, the latticed three dimensional geometrical structure of FIG. 4A, is built up by first using tubes 7 and wires 8 bent at an angle of 90° to construct a one-plane, two-dimensional grid as the first layer of the structure, with one end of the wires projecting vertically out into the air, then putting tubes on the vertically-projecting ends of the wires, and then building up the geometrical structure on the vertical tubes. In this way, the first layer two-dimensional grid works as a "baseboard", and the vertically projecting tubes work as the supporting poles, and the function of a separate baseboard 1 is replaced by the first layer tube-and-wire grids.

Figure 11A:
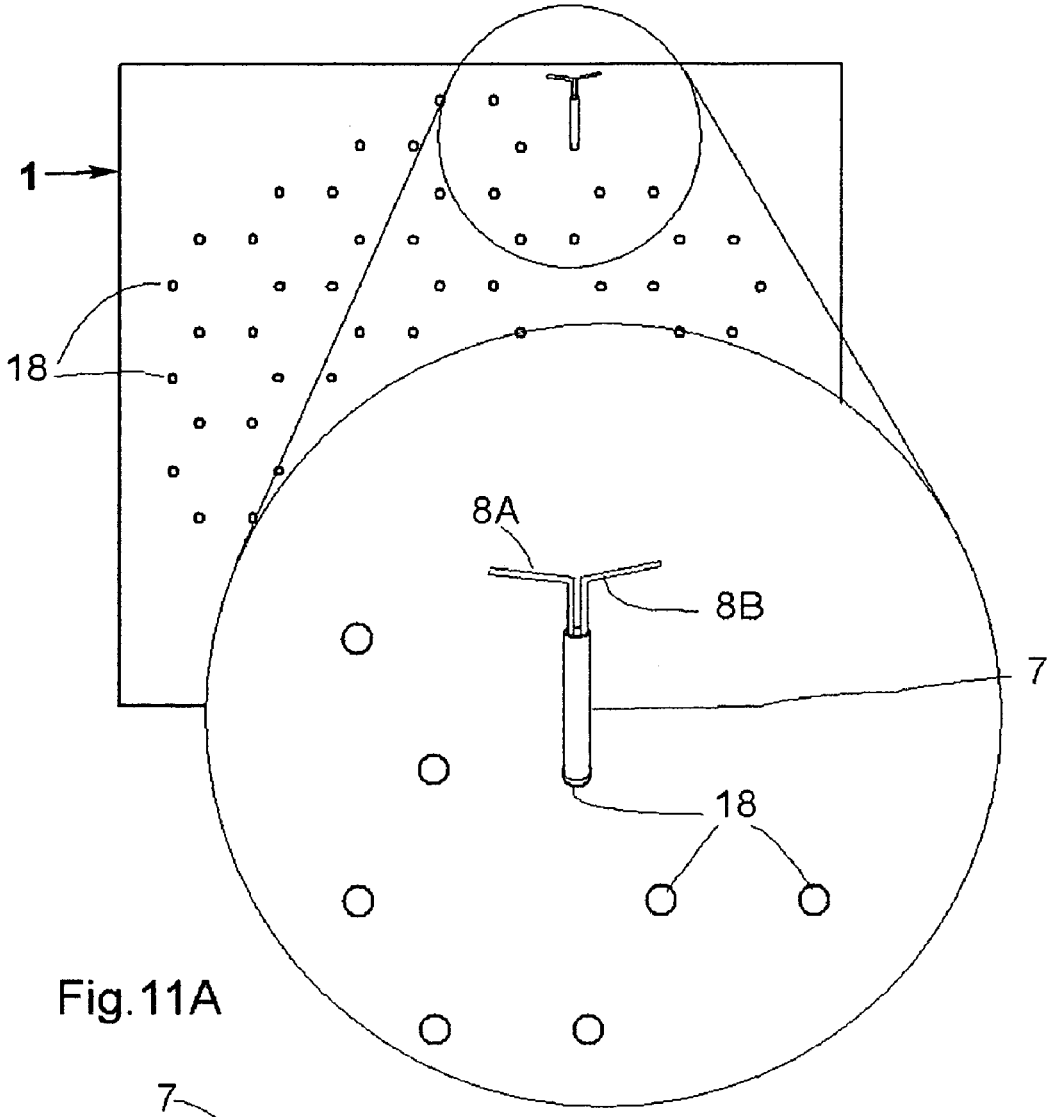
FIG. 11A depicts how a tube with wire connectors is connected to a baseboard.
Figure 11B:
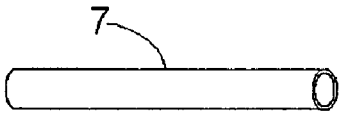
FIG. 11B illustrates a tube.
Figure 11C:
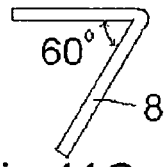
FIGS. 11C to 11G illustrate wire connectors of different shapes.
Figure 11D:
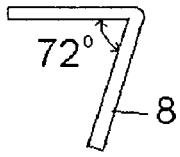
Figure 11E:
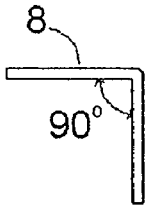
Figure 11F:
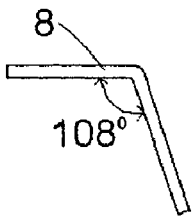
Figure 11G:
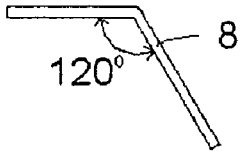
Figure 12:
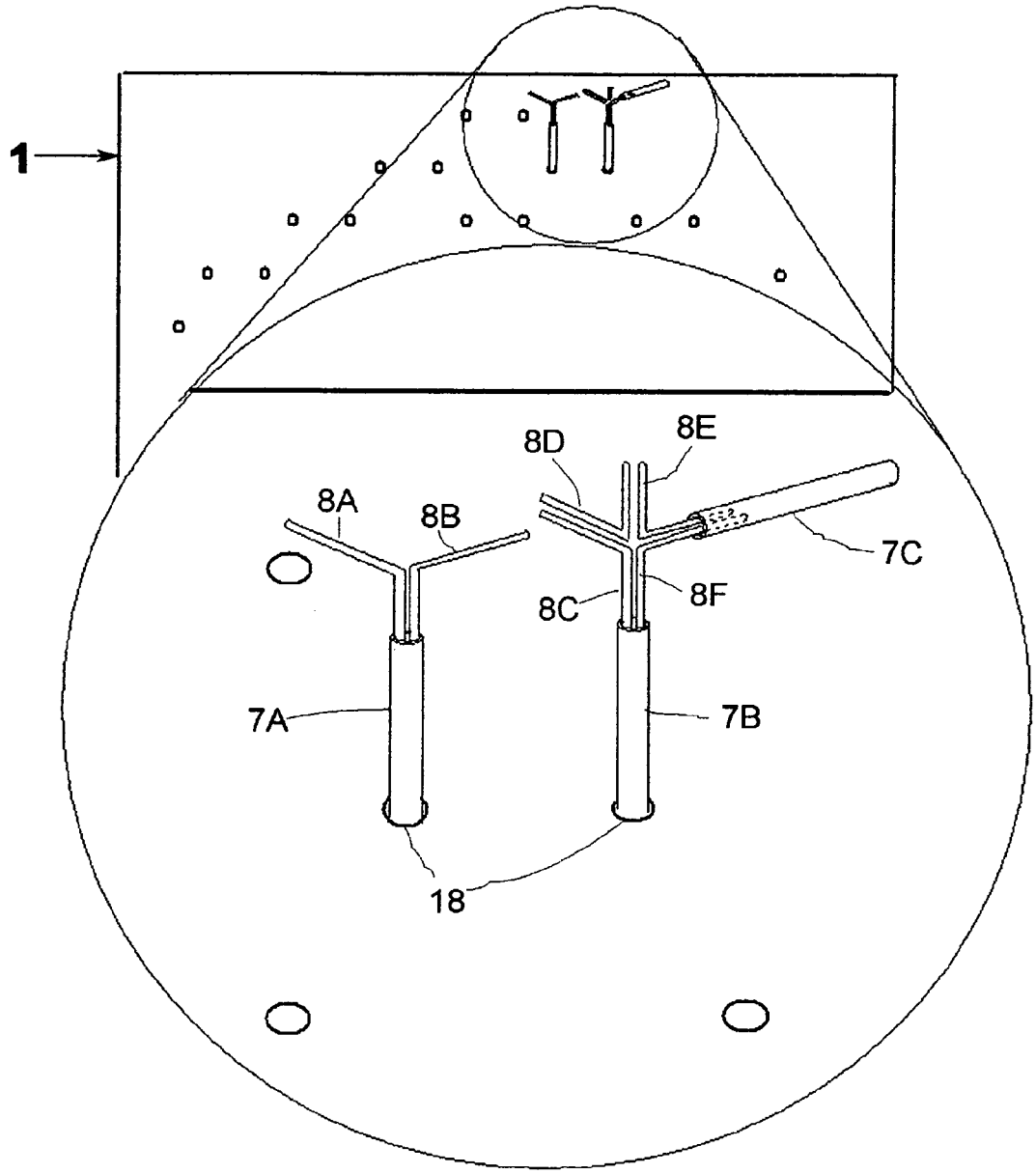
FIG. 12 illustrates some tube-and-wire connector assemblies.
Figure 13:
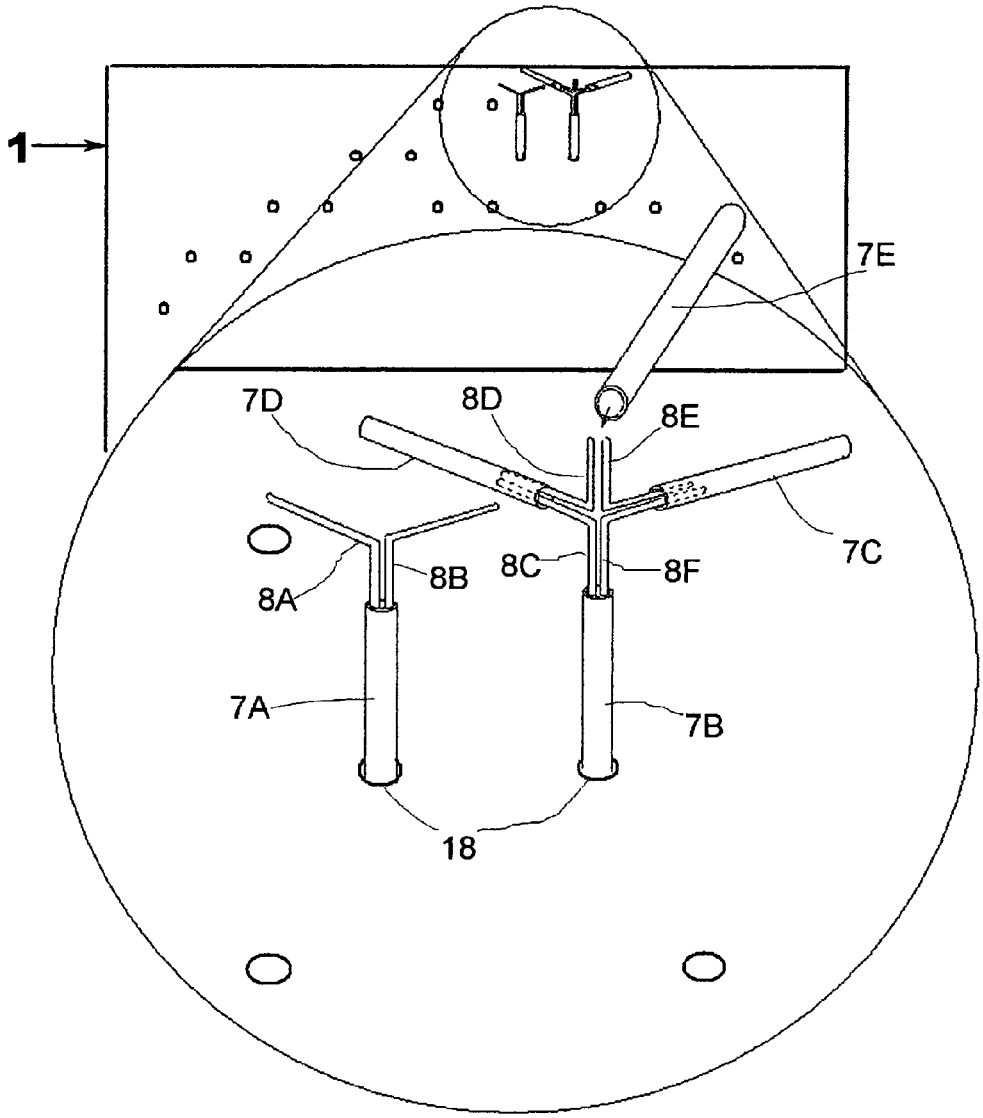
FIG. 13 is a view like FIG. 12 with additional legend.

Referring now to the zoomed area of FIG. 11A, two wire connectors 8A and 8*b* are plugged into a tube 7 which is plugged into a hole 18 of baseboard 1. In order to fit two wire connectors such as the connectors 8A and 8B properly, the inner diameter of tube 7 is equal to two wire diameters, whereby the ends of two wire connectors can be accommodated in a tight fit. FIGS. 12 and 13 illustrate the addition of a second assembly of tubes and wire connectors to begin construction of a geometric structure game device. In FIG. 12 the second assembly consists of two tubes 7B and 7C and four wire connectors 8C–8F. In FIG. 12 it is to be understood that the free ends of connectors 8D and 8E extend in the same plane as tube 7C. In FIG. 13, two additional tubes 7D and 7E are provided. Tube 7D is mounted on the ends of wire connectors 8C and 8D and tube 7E is shown ready to accept secure the free ends of connectors 8D and 8E, whereby the mutually adjacent corner sections of the four wire connectors 8C–8F form a 3-degree of freedom node for receiving a game piece having three radial slots in the manner described hereinafter in connection with FIGS. 15*a*1 to 15*c*5.

For purposes of definition, clarity and claim coverage, and as used in the context of game devices having a structure formed by tubes and wire connectors, e.g., as exemplified in FIGS. 12 and 13, the term "node" identifies a cluster of wire connector elbow sections that are in proximity to each other, with the opposite ends of those wire connectors being captured in tubes that extend at an angular relation to one another according to the angles of the elbow sections of the wire connectors in the cluster, and with each tube having the ends of two wire connectors captured in at least one end of the tube.

Referring to FIG. 13, the order in which the tubes and wire connectors are assembled to form a geometrical structure as herein described can be varied. For example, the 3 degree node illustrated in FIG. 13 can be assembled by first inserting one end of wire-connector 8C and one end of wire connector 8F into tube 7B. Then one end of wire connector 8E and tube 7C can be coupled to the free end of wire connector 8F as shown in FIG. 12. Next tube 7D and one end of wire connector 8D can be coupled to the free end of wire connector 8C. Thereafter tube 7E can be pressed onto the free ends of wire connectors 8D and 8E. 7D. In this way, the ends of two different wire connectors 8 are inserted into each tube, with each such pair of wire-connector ends forming a "plug" that is large enough to make a close or tight fit in a tube 7, whereby the wire connectors secure together tubes 7B–7D. The same tube and wire method of construction can be applied to form nodes with different degrees of freedom. For example, a 4-degree node can be formed by attaching 5 wire connectors to 5 tubes (one of the 5 tubes acts as a supporting leg that is anchored in a hole in a baseboard; a 5-degree node can be formed by attaching 6 wire connectors to 6 tubes (with one of the six tubes acting as a supporting leg anchored in a hole in a baseboard).

Figure 14:
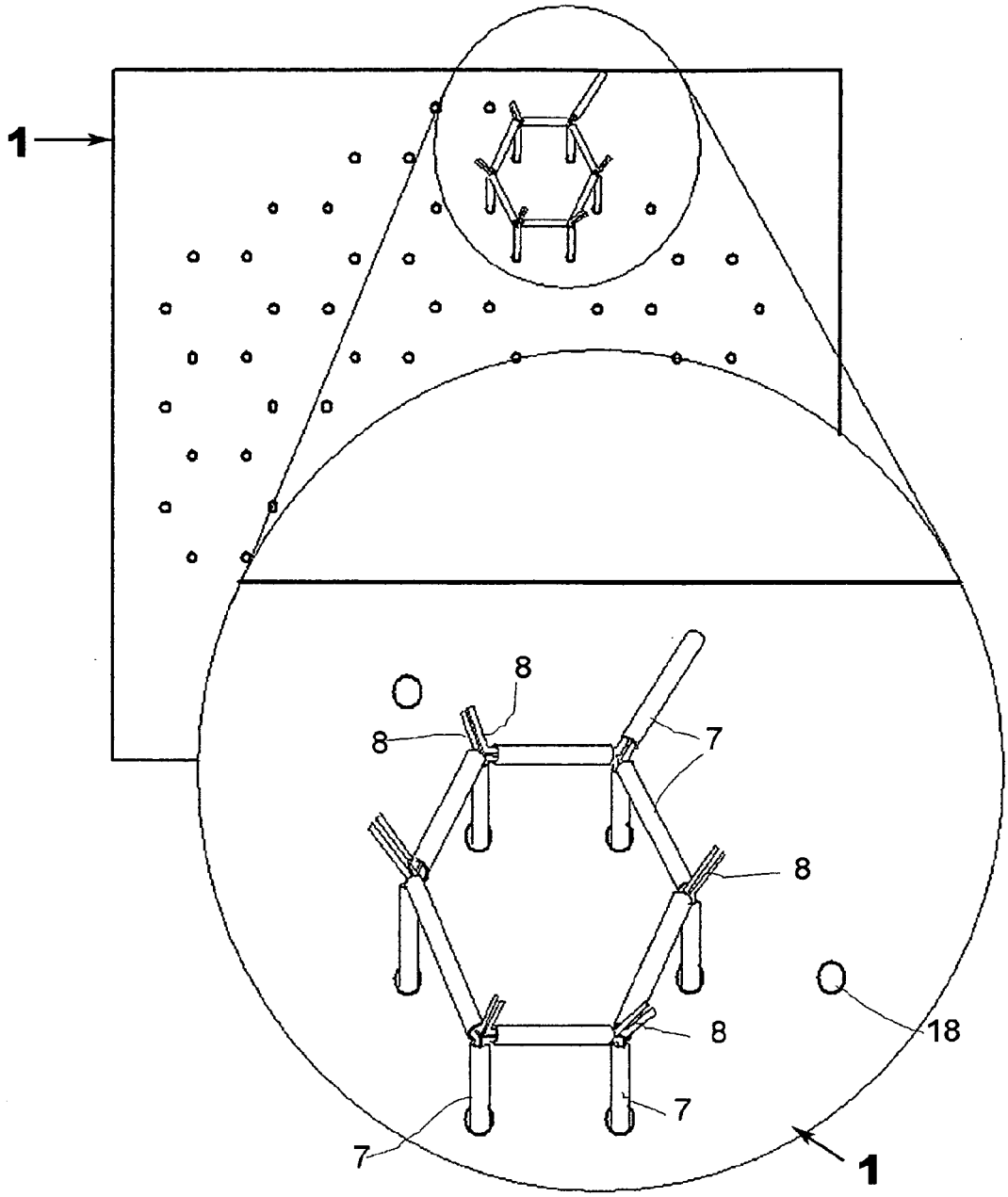
FIG. 14 is a perspective view of a part of a honeycomb game device structure made by tubes and wire connectors.

A more complicated case of the tube-and-wire mode of construction is shown in FIG. 14. This drawing illustrates the beginning of construction of a three-dimensional honeycomb structure. A hexagon shape has been made by the tube-and-wire connecting method. At five of the six corners of the hexagon, two wire ends 8 project out waiting for a tube to be attached thereto like tube 7E described above. After tubes have been attached to each pair of projecting wire ends, another run of tube-and-wire connections can be added to form another layer of the structure. In this way, the whole structure can be built up layer by layer.

The game pieces 3 of the present invention are categorized by their degrees of freedom as defined by the number of slots that extend outward radially from the center of the piece. For example, if there are 4 slots on a game piece, the game piece is a four-degree game piece, intended for embedding on a four-degree node. The width of each slot in the game pieces is sized to accommodate two wire connectors in side by side relation, e.g. wire connectors 8D and 8E in FIG. 12.

Figure 1B:
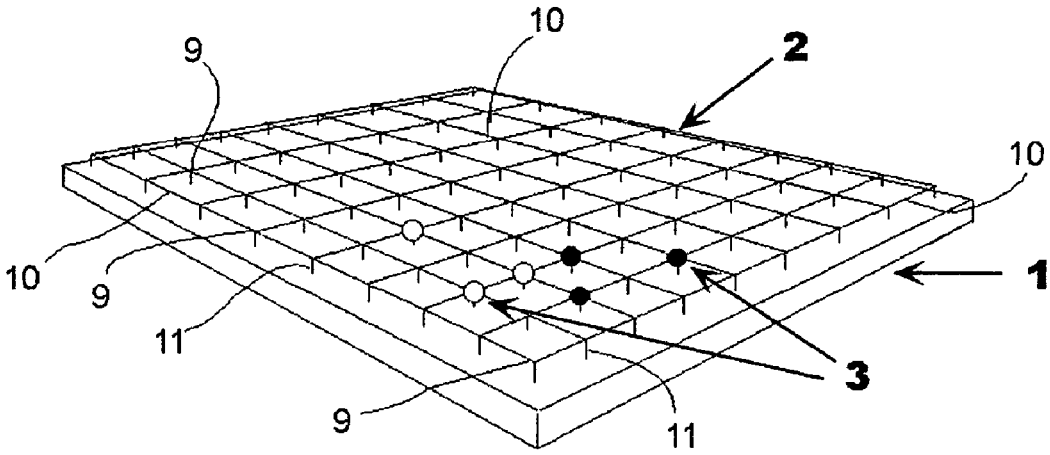
FIG. 1B is the perspective view of the same game device on a baseboard with several game pieces embedded on nodes of the structure.

FIG. 15*a*1 to FIG. 15*c*5 depicts three spherical game pieces 3. FIG. 15*a*1 is the top view of 4-degree game piece 3A. This is a 4-degree game piece that will be used for embedding on 4-degree nodes, e.g., the inside nodes of the device of FIG. 1B. FIG. 15*a*2 is the front view of the same 4-degree game piece. FIG. 15*a*3 is the side view of the 4-degree game piece. FIG. 15*a*4 is the section view of the 4-degree game piece. FIG. 15*a*5 is the perspective view of the 4-degree game piece. Game piece 3A has four intersecting radial slots 20A that are spaced apart by 90°.

FIG. 15*b*1 is the top view of the 6-degree game piece 3B that is provided for embedding on 6 degree nodes. FIG. 15*b*2 is the front view of the 6-degree game piece. FIG. 15*b*3 is the side view of the 6-degree game piece. FIG. 15*b*4 is the section view of the 6-degree game piece. And FIG. 15*b*5 is the perspective view of the 6-degree game piece. Game piece 3B has six intersecting radial slots 20B with equal angle spacing between them.

FIG. 15*c*1 is the top view of the 5-degree game piece 3C for embedding on 5 degree nodes. FIG. 15*c*2 is the front view of the 5-degree game piece. FIG. 15*c*3 is the side view of the 5-degree game piece. FIG. 15*c*4 is the section view of the 5-degree game piece. And FIG. 15*c*5 is the perspective view of the 5-degree game piece. Game piece 3C has five radial slots 20C with equal angle spacing between them. Although not shown, a game piece for a three degree node would leave three intersecting radial slots 20C to accommodate the three pairs of wires that make up the three degree node.

FIG. 16 to FIG. 28 serve to illustrate rules of the strategy game. A three-dimensional, 16-plane, non-latticed game device with 3 degree nodes is used to explain these rules. At the beginning, no game pieces are positioned on the game device. The game is played by two players, who put game pieces in turn on nodes of the game device. There are two colored game piece groups to distinguish the two players. In the picture, the black-colored game piece moves first, then the white one, and then the black one, and so on. In FIGS. 16 to 28, the numeral label on the several pieces indicates the order in which they are moved.

The first rule states: "There are two game piece groups with identical color. Each color associates to a single player." In FIG. 16, two game pieces are embedded on the nodes of the structure, one is black and the other is white. The second rule states: "The game device pattern should be designed, determined and accepted by both sides." Since this multi-plane strategy game has no unique uniformed "standard" game device, it is players' duty to decide which game device pattern should be used. Players may choose an existing game device patterns or create a new pattern under the agreement of both sides.

Figure 16:
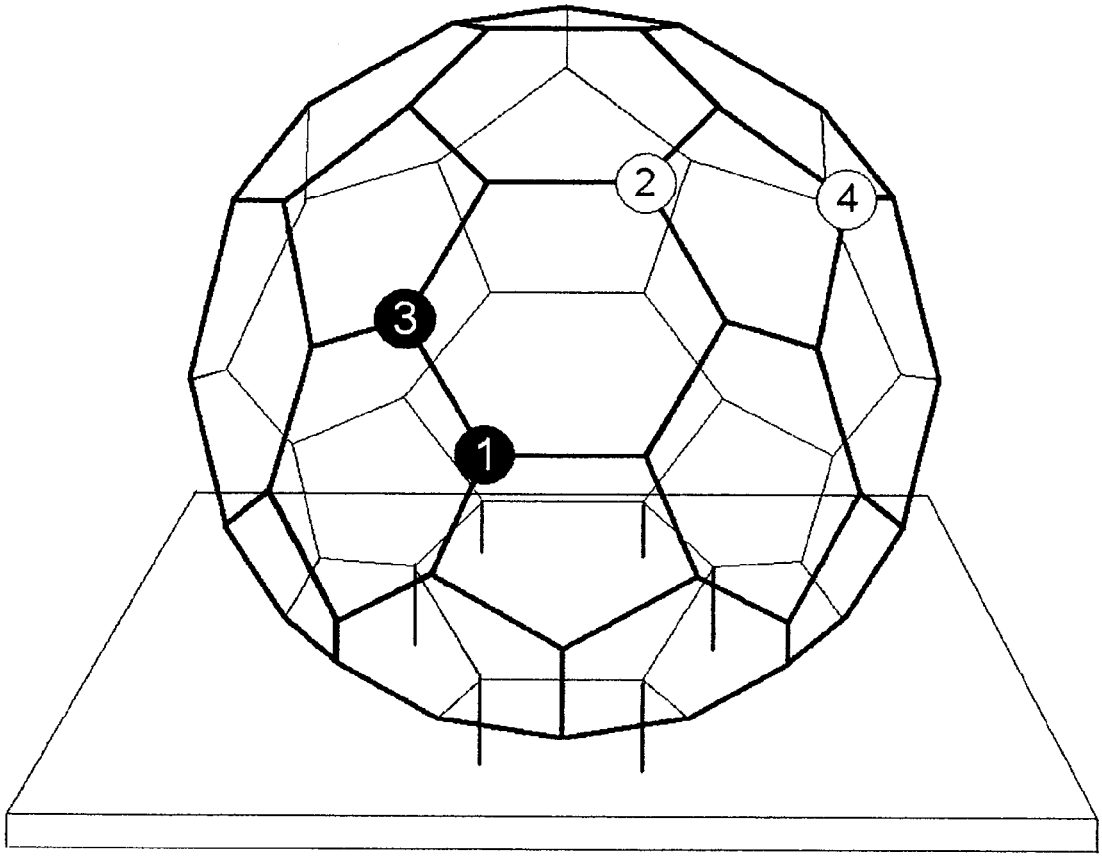
FIG. 16 is the view of a three-dimensional, 16-plane non-latticed mono-degree game device with pieces on the nodes, which depicts some of the game rules.

The third rule states: "When a game starts, no game pieces are positioned in the game device." That means this multi-plane strategy game does not have pre-setting pieces on the game device before the game starts. The fourth rule states: "Each player embeds one game piece in turn on a node of the game device. The dark colored game piece moves first." The FIG. 16 depicts this rule. The black piece moves first on position "1", then white one moves on position "2". And then, in turn, black moves on "3". After that, the white piece moves on "4". The fifth rule states: "Once a game piece is embedded on a node, moving or removing it is not allowed unless it is captured or the game is over." That means the game pieces of this strategy game are not moveable like game pieces in Chess.

Figure 17:
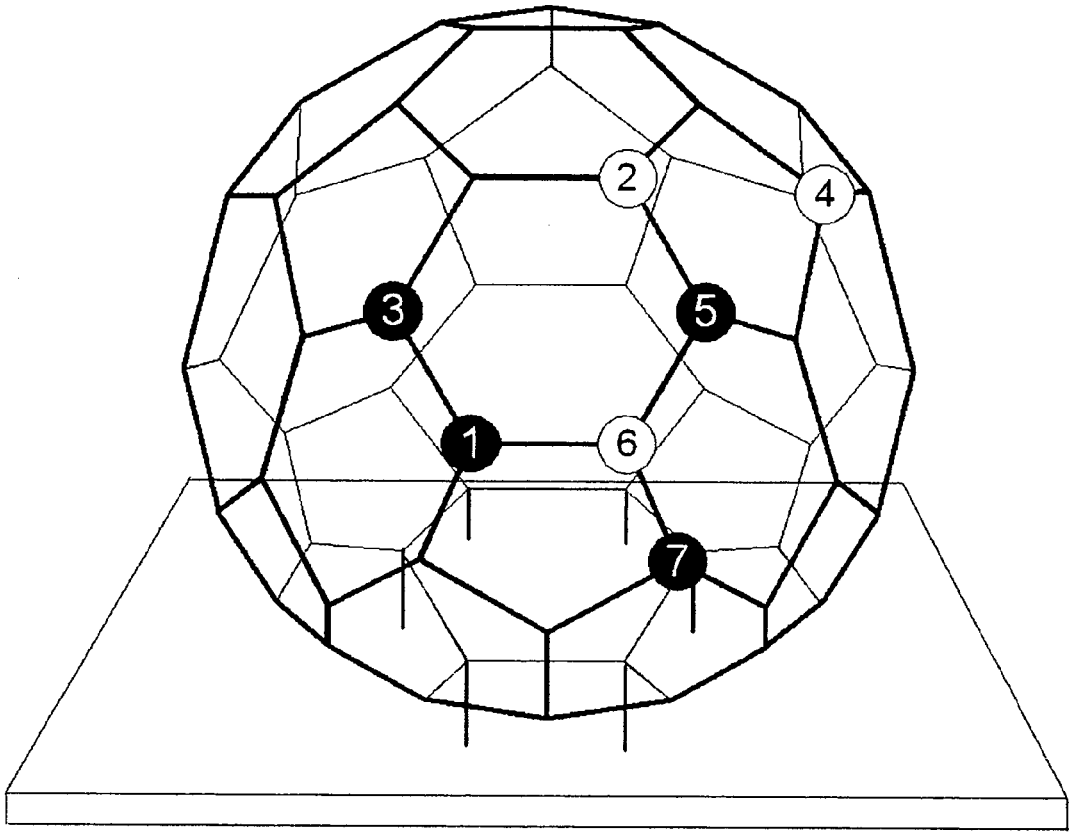
FIGS. 17–28 illustrate play of a game with the game device of FIG. 16.
Figure 18:
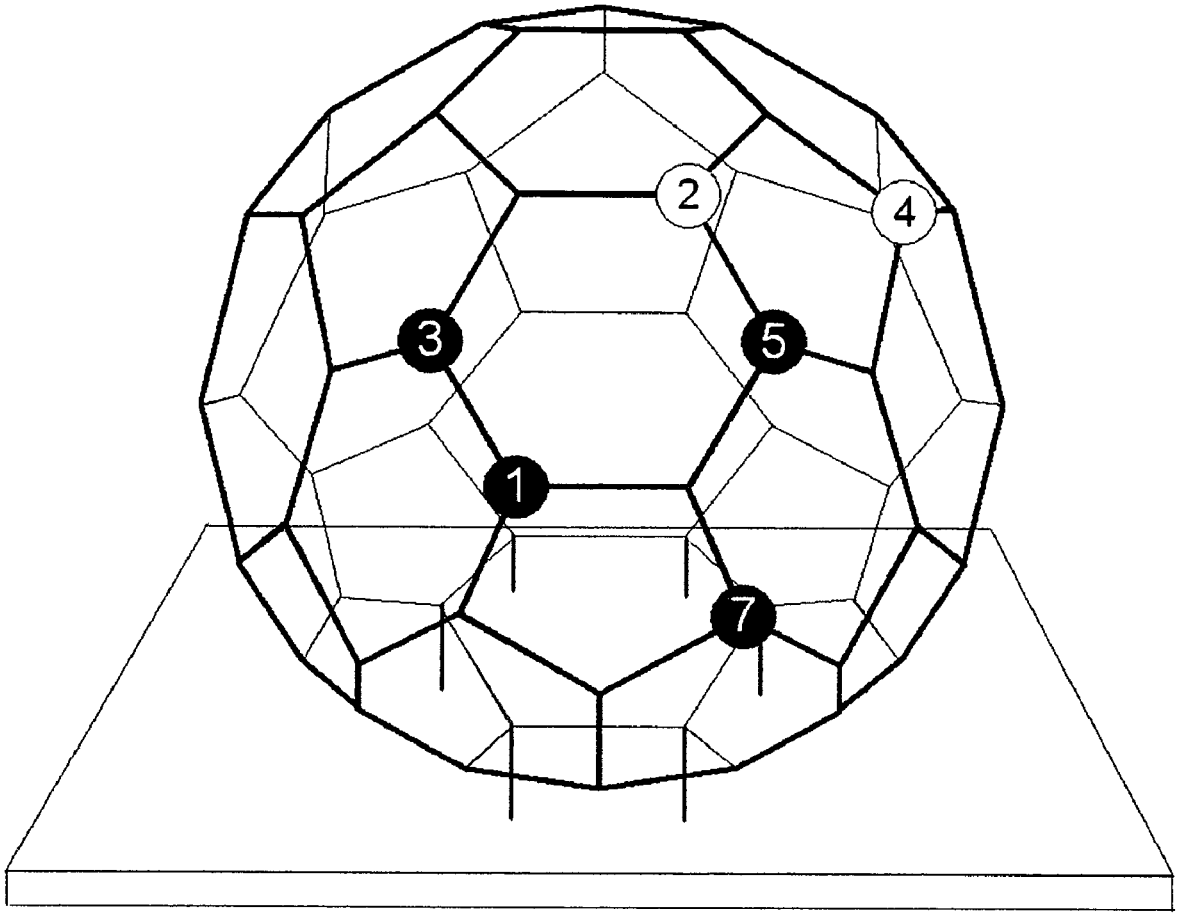
Figure 19:
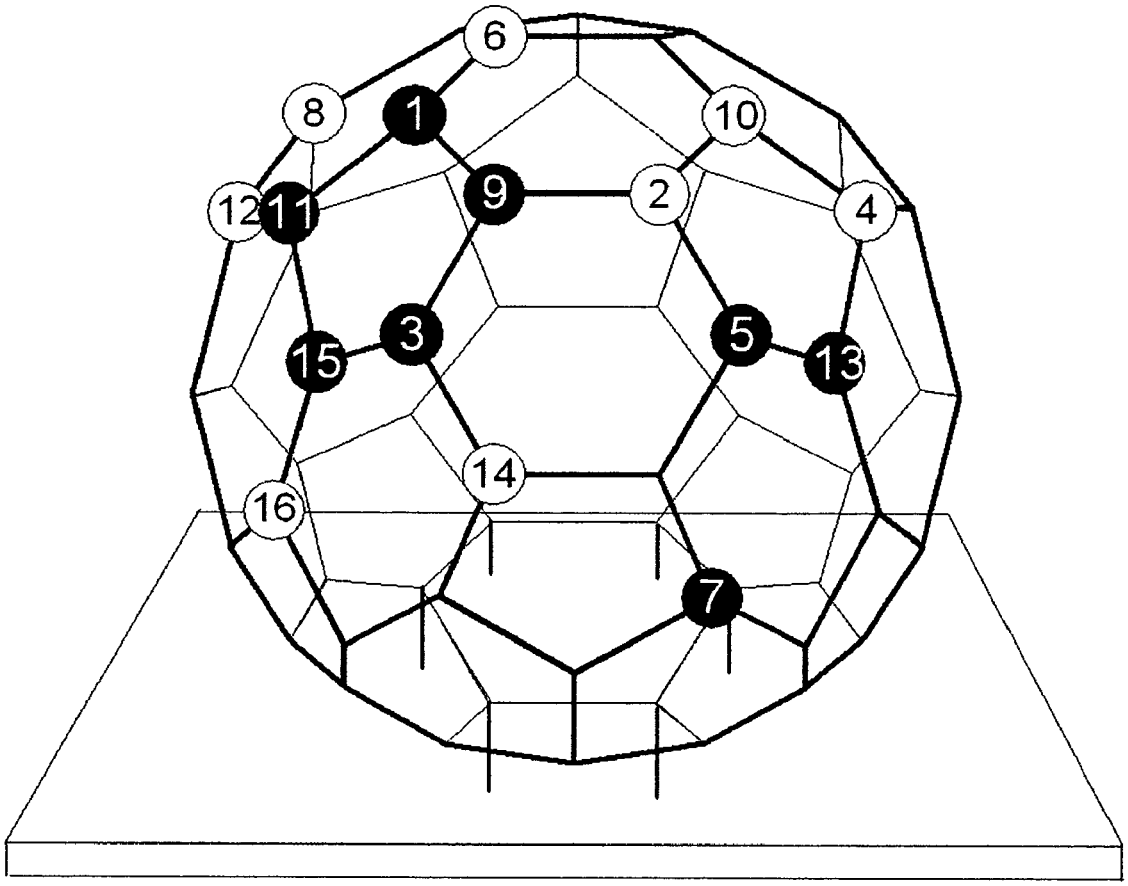
Figure 20:
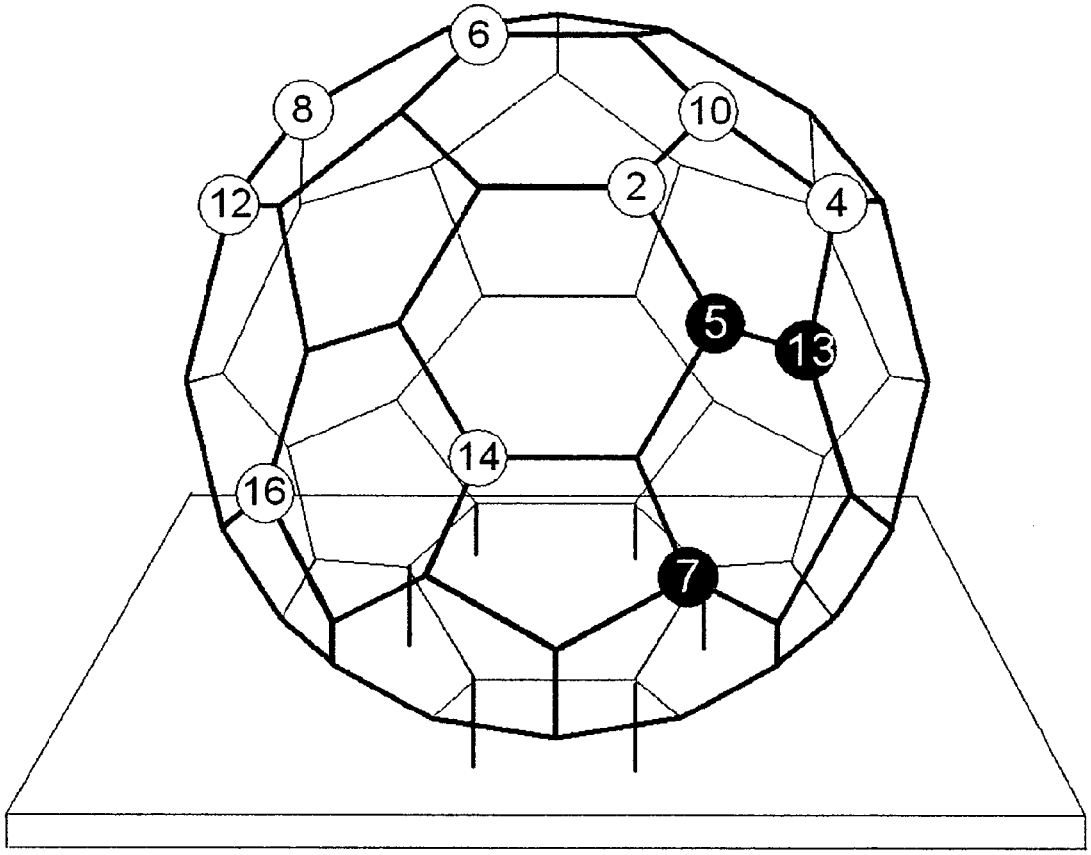
Figure 21:
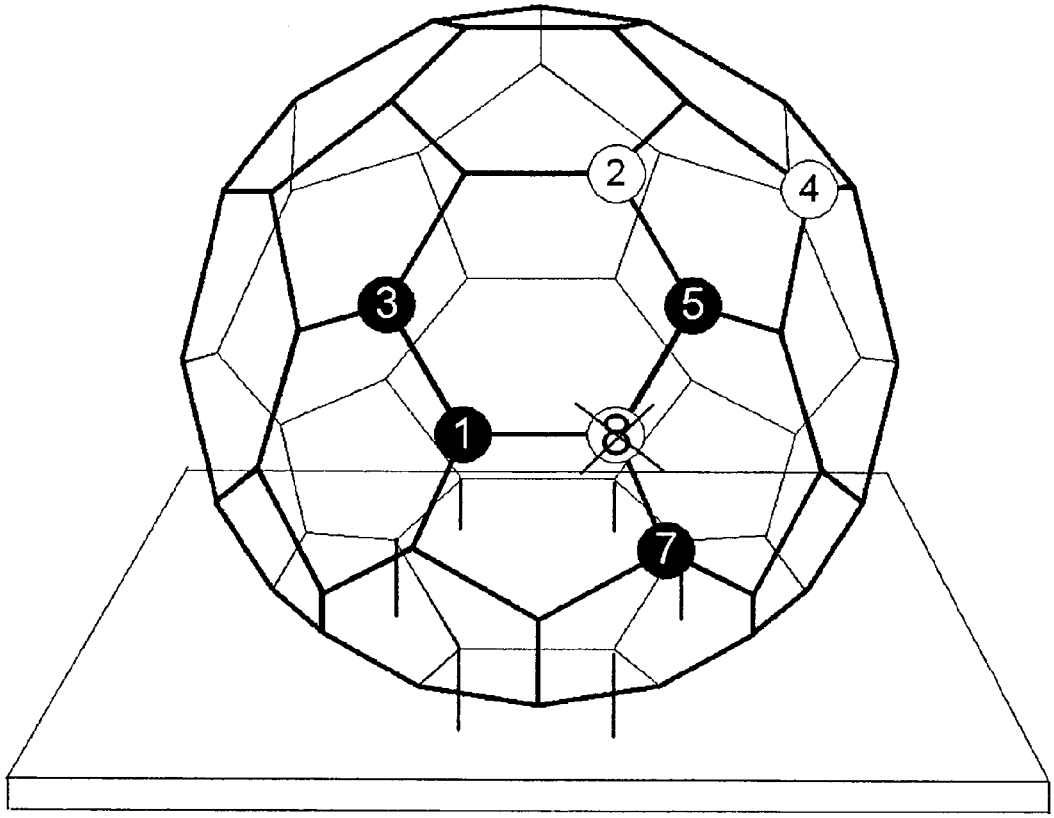

The sixth rule states: "A piece is captured if all its adjacent nodes were occupied by opponent pieces. A group of pieces are captured if all its adjacent nodes were occupied by opponent pieces and there are no non-occupied nodes inside this group." FIG. 17 to FIG. 20 depicts this rule in details. In FIG. 17, black piece "7" captured white piece "6" since all adjacent nodes of "6" are occupied by black pieces after "7" embedded on the node. Then FIG. 18 shows what it looks like after white piece "6" was captured. FIG. 19 shows how a group of black pieces is captured by white pieces when white piece "16" is embedded on the node. And then, FIG. 20 shows how it looks like after piece "16" captured the group of black pieces.

The seventh rule states: "Suicide is forbidden." FIG. 21 indicates that piece "8" involved an illegal movement. Since all adjacent nodes of the position "8" are occupied by black pieces, putting a white piece on the node is equal to suicide; so it is illegal. The eighth rule states: "Immediate counter capture is not allowed." This rule is very important for the game to progress fairly and reasonably. Without this rule, the game will be locked in an endless capture and counter captures process. FIG. 22 to FIG. 28 depicts this rule.

Figure 22:
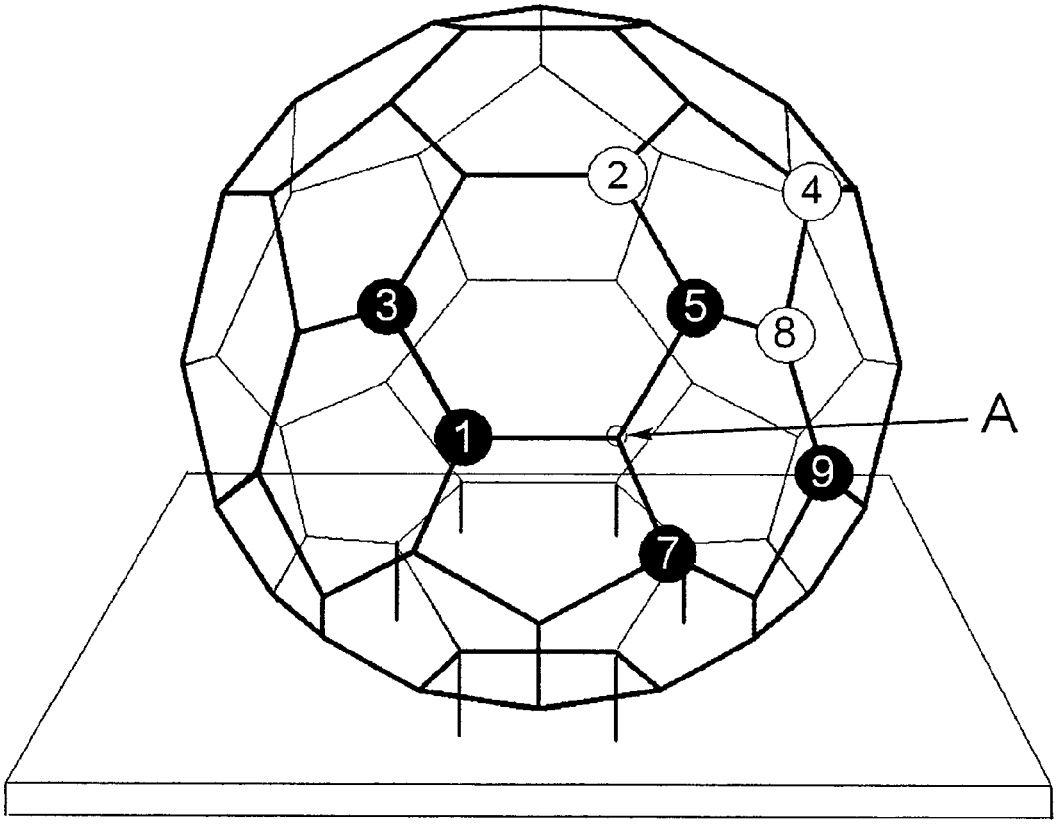
Figure 23:
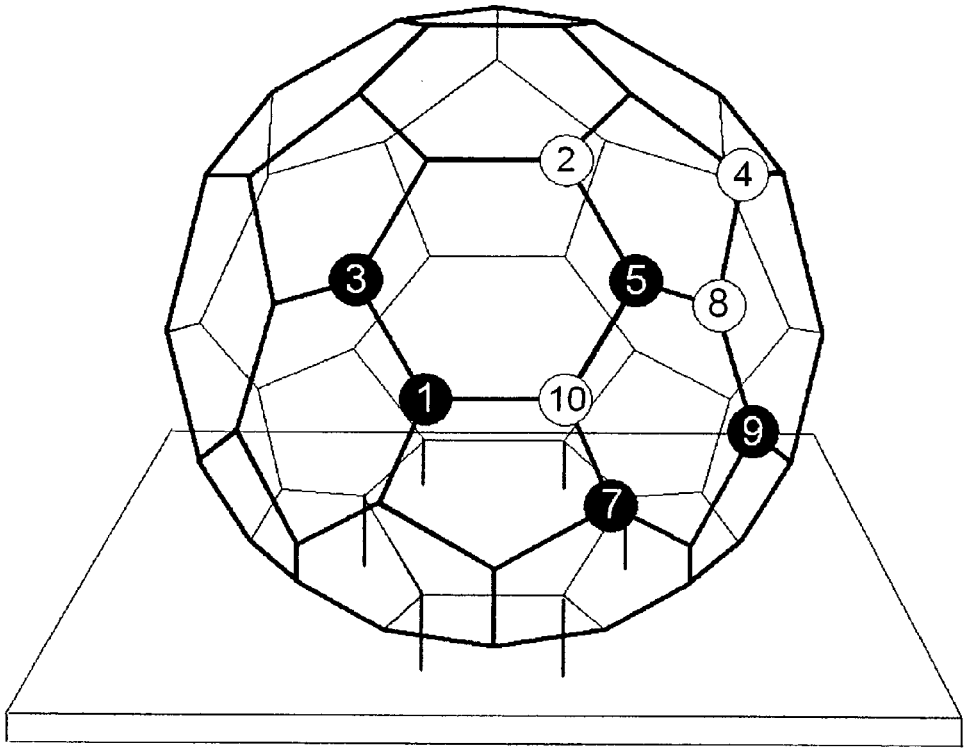

FIG. 22 points the node "A", which is surrounded by black pieces. However, if a white piece puts on node "A", it will not be a suicide because it captures the black piece "5". FIG. 23 shows the legal move of white piece numbered "10". After white piece "10" being put on the game device, the black piece "5" is captured.

Figure 24:
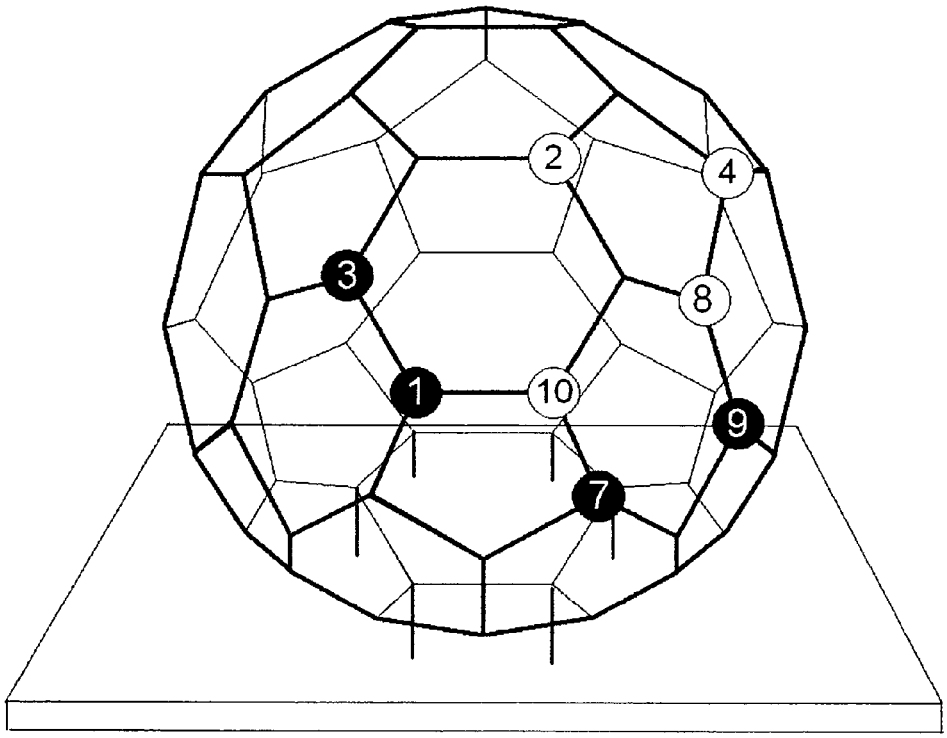
Figure 25:
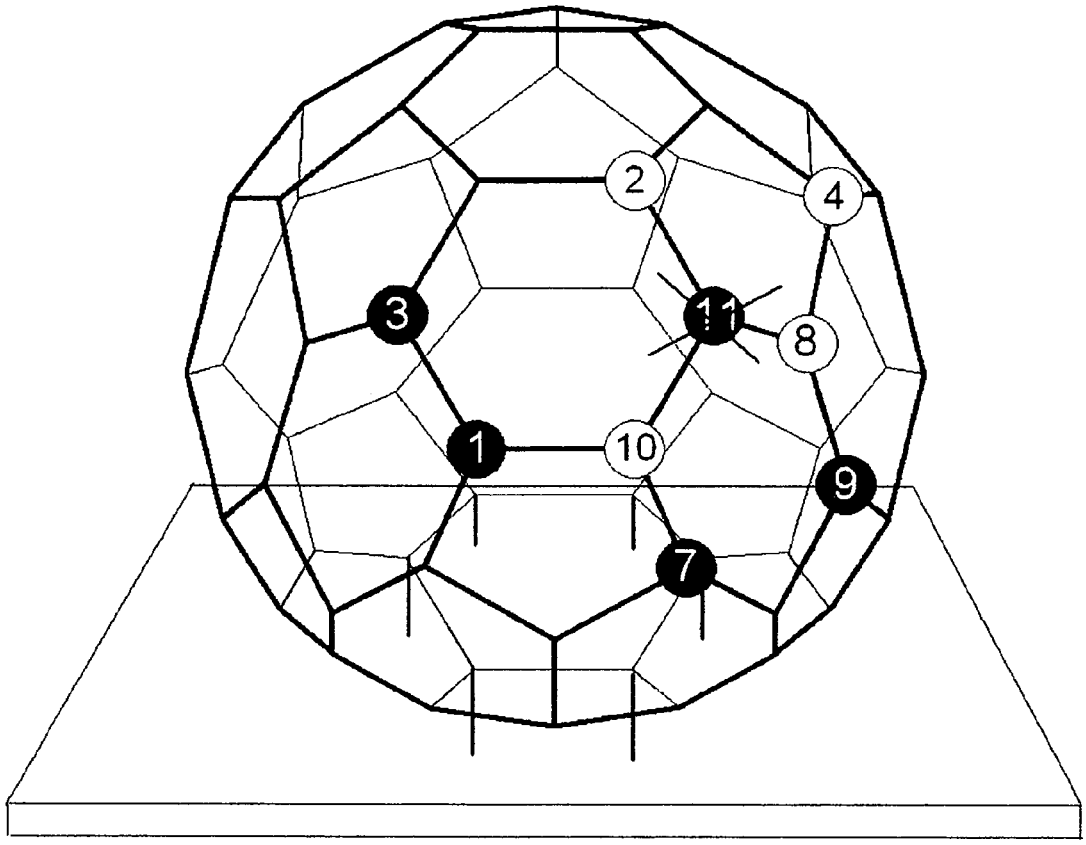
Figure 26:
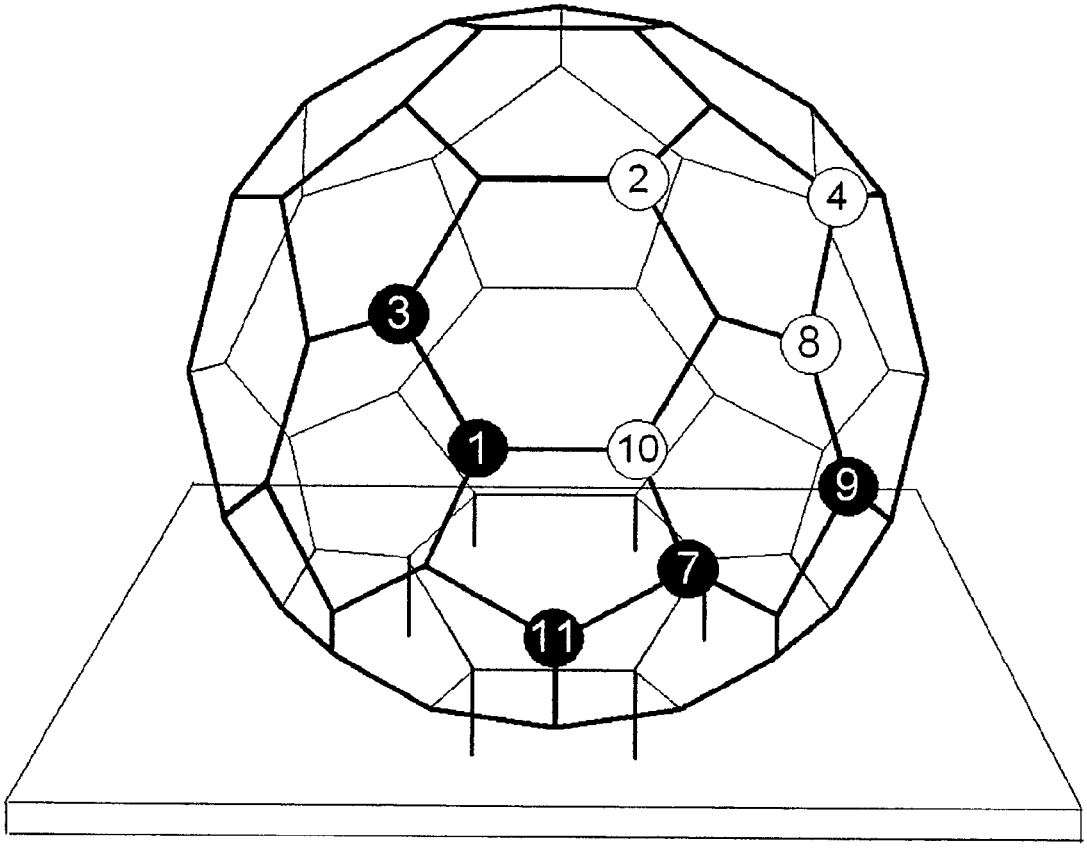
Figure 27:
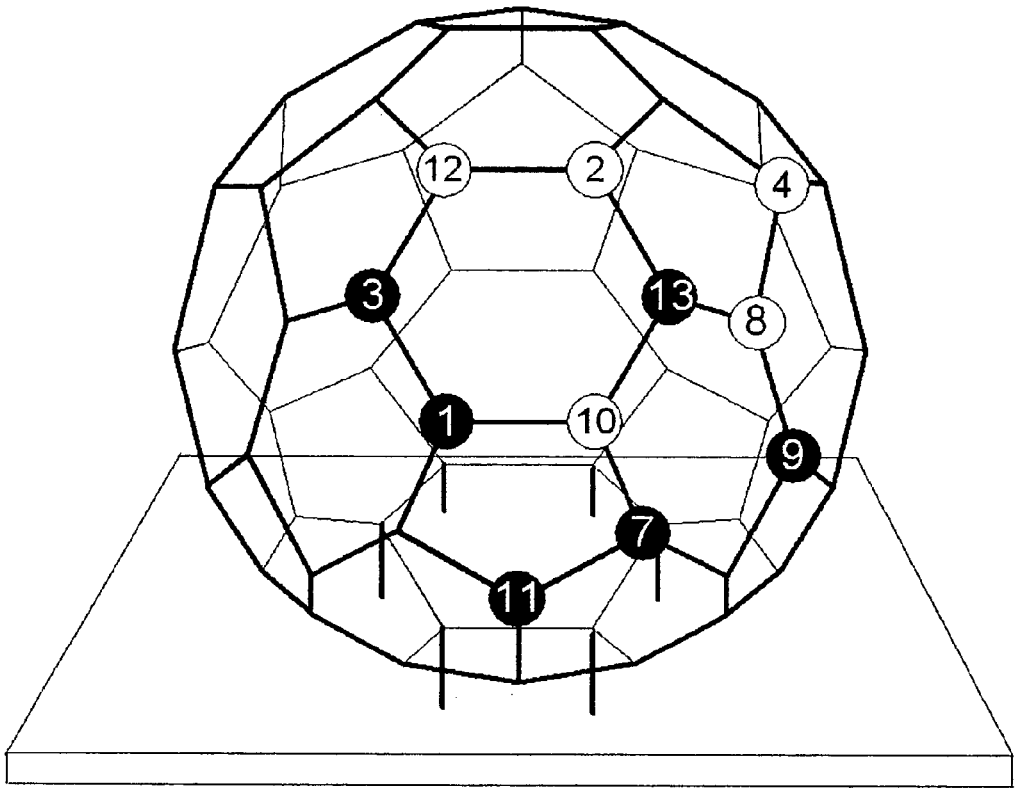
Figure 28:
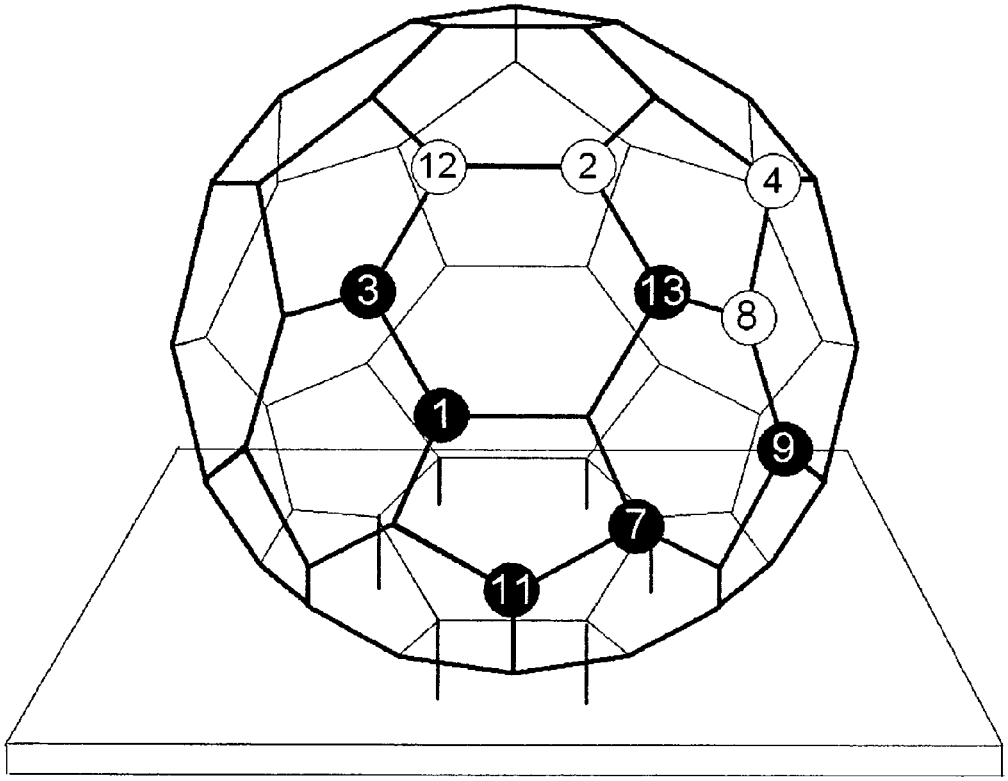

FIG. 24 shows the result of FIG. 23. After white piece "10", black piece "5" is removed from the game device. According to the eighth rule, after white piece "10" captured black piece "5" of FIG. 23 and FIG. 24, the black piece is not allowed to put back on the node to counter capture white piece "10" immediately. FIG. 25 depicts the illegal move of black piece "11". FIG. 26 depicts the legal moves after the white piece "10" captured black piece "5" of FIG. 23 and FIG. 24. In this picture, black piece "11" does not do immediate counter capture but moves to other position. After that, the white piece "12" can either put the piece on the position "5" of FIG. 23 or put on somewhere else. FIG. 27 shows that white piece "12" does not put on the position "5" of FIG. 23. Since the white piece "12" did not fill in the position of "5" of FIG. 23, the black piece has a chance to fight back and capture white piece "10". The black piece "13" then captures white piece "10". FIG. 28 shows the result of counter capture done by black piece.

The player who occupies more nodes than its opponent wins a game. However, since certain nodes of a game device are with more advantage than other nodes and the first occupier of these nodes usually has more advantages, the present invention sets up rules inclining to the second mover of the game to balance the second mover's disadvantage. For example, in the latticed three-dimensional game device, the $2^{nd}$ and $3^{rd}$ line nodes from corner point can control the nodes of the corner easily and efficiently. To occupy the whole corner, one or two game pieces on these nodes will do. So, the first occupier of these key nodes will have more advantage than that of the second mover. For this reason, the ninth rule states that If the number of nodes of a game device is odd and total nodes equal to "N", the player who moves first wins the game if said player occupied at least (N+1)/2+1 nodes. If the number of nodes of a game device is even and total nodes equal to "N", the player who moves first wins the game if said player occupied at least N/2+1 nodes.

What is claimed is:

1. A game apparatus comprising a geometric game device and game pieces for use with the game device, said game device comprising a three dimensional geometric structure that is formed by a plurality of tubes and a plurality of wire connectors having their opposite ends mounted in the ends of said tubes and is characterized by a plurality of nodes for placement of the game pieces, with each node comprising a cluster of angular elbow sections of said connector wires with each cluster comprising at least two elbow sections in proximity to each other; and said game pieces having a plurality of slots for accommodating the angular elbow sections of one of said clusters, whereby said each game piece can be positioned at a node by placing the game piece so that all of the angular clustered elbow sections making up said node are received in the slots of said game piece in supporting relation to said game piece.

2. Apparatus according to claim 1 wherein said game pieces have a generally spherical shape.

3. Apparatus according to claim 1 wherein two wire connectors are attached to at least one end of each tube.

4. Apparatus according to claim 1 wherein some nodes comprise at least four angular elbow sections.

5. Apparatus according to claim 1 wherein each cluster consists of three pairs of angular sections.

6. Apparatus according to claim 1 wherein each cluster consists of four pairs of angular sections.

7. Apparatus according to claim 1 wherein said three dimensional geometric structure is a multi-plane latticed structure.

8. Apparatus according to claim 1 wherein said three dimensional geometric structure is a multi-plane non-latticed structure.

9. Apparatus according to claim 1 further including a board for supporting said game device, said board comprising a plurality of holes, and further wherein some of the tubes of said structure are installed in said holes and act as supports connecting said structure to said board.

10. Apparatus according to claim 1 wherein at least some of said game pieces have three slots extending at angles to one another.

11. Apparatus according to claim 1 wherein at least some of said game pieces have four slots extending at angles to one another.

12. Apparatus according to claim 1 wherein at least some of said game pieces have five slots extending at angles to one another.

13. Apparatus according to claim 1 wherein said three dimensional geometric structure is an icosahedron or a dodecahedron.

14. Apparatus according to claim 1 wherein at least some of said tubes and connector wires form a plurality of three or four-sided polygons.

15. A game apparatus comprising a game device and game pieces for use with the game device;

said game device comprising a geometric structure consisting of a plurality of tubes and a plurality of wire connectors, each wire connector having first and second ends and being bent so as to have an angular elbow section intermediate said first and second ends, each wire connector having its first end inserted in one end of a tube and its other end inserted in one end of another tube, and each tube having the ends of two wire connectors inserted in at least one end of said each tube, with the angular elbow section of each wire connector being adjacent to the angular elbow section of at least one other wire connector so as to form a cluster of elbow sections with each cluster serving as a node for a game piece; and the game pieces are grouped according to two different colors or color patterns, with each game piece being characterized by a plurality of angularly spaced slots equal in number to the number of pairs of wire connector elbow sections that are in a cluster, said slots being sized so that each game piece can be embedded on a cluster with the wire connector ends forming the cluster residing in the slots of the game piece.

16. Apparatus according to claim 15 wherein said game pieces have a spherical shape and said slots intersect a common axis of said game pieces.

17. Apparatus according to claim 15 wherein the elbow sections in each cluster are in angular relation to one another.

18. Apparatus according to claim 15 wherein each cluster comprises at least three elbow sections.

19. A game apparatus comprising a game device and game pieces for use with the game device;

the game device comprising a plurality of nodes for receiving and supporting the game pieces, with each node comprising a cluster of angular elbow sections of connector wires that are connected together in a geometric structure by a plurality of tubes, with at least one end of each tube having the ends of two connector wires inserted therein; and each game piece having a plurality of slots for accommodating the angular elbow sections of one of said clusters, whereby said each piece can be positioned on a node by placing said each piece so that all of the wire sections in the cluster are received in said slots.

* * * * *